US012768168B2

(12) United States Patent
Yin et al.

(10) Patent No.: US 12,768,168 B2
(45) Date of Patent: Oct. 20, 2026

(54) REINFORCEMENT CAGE FOR END MEMBER OF SHEAR WALL, JIG FOR MAKING REINFORCEMENT CAGE AND METHOD FOR MAKING REINFORCEMENT CAGE

(71) Applicant: RUENTEX ENGINEERING & CONSTRUCTION CO., LTD., Taipei City (TW)

(72) Inventors: Samuel Yin, Taipei City (TW); Jui-Chen Wang, Taipei City (TW); Jhih-Syuan Chen, Taipei City (TW)

(73) Assignee: RUENTEX ENGINEERING & CONSTRUCTION CO., LTD., Taipei City (TW)

( * ) Notice: Subject to any disclaimer, the term of this patent is extended or adjusted under 35 U.S.C. 154(b) by 234 days.

(21) Appl. No.: 18/442,979

(22) Filed: Feb. 15, 2024

(65) Prior Publication Data

US 2024/0287802 A1 Aug. 29, 2024

(30) Foreign Application Priority Data

Feb. 24, 2023 (TW) ..... 112106905

(51) Int. Cl.
*E04C 5/06* (2006.01)
*B21F 15/04* (2006.01)

(52) U.S. Cl.
CPC ..... *E04C 5/0604* (2013.01); *B21F 15/04* (2013.01)

(58) Field of Classification Search
CPC ..... E04C 5/0609; E04C 5/0622; B21F 27/125
See application file for complete search history.

(56) References Cited

FOREIGN PATENT DOCUMENTS

| | | | | |
|---|---|---|---|---|
| CN | 107574977 A | | 1/2018 | |
| EP | 0956406 B1 | * | 5/2001 | ..... E04H 9/02 |
| WO | WO-2006079639 A1 | * | 8/2006 | ..... E04C 5/0604 |

* cited by examiner

*Primary Examiner* — Patrick J Maestri
(74) *Attorney, Agent, or Firm* — Juan Carlos A. Marquez; Marquez IP Law Office, PLLC

(57) ABSTRACT

The subject disclosure relates to a reinforcement cage, a jig and a method for making the reinforcement cage. The reinforcement cage includes a plurality of reinforcement units, which are arranged along a first direction, and a plurality of main bars. Each reinforcement unit includes a first stirrup, which is substantially rectangular, at least one second stirrup and at least one third stirrup. The first stirrup includes a first side, a second side, a third side and a fourth side. The first side and the third side are opposite to each other, and the second side and the fourth side are opposite to each other. The at least one second stirrup is connected to the first side and the third side of the first stirrup. The at least one third stirrup is connected to the second side and the fourth side of the first stirrup and substantially perpendicular to and fixed to the at least one second stirrup. The plurality of main bars extend along the first direction and through the reinforcement units, are adjacent to the first side, the second side, the third side and the fourth side of the first stirrup and are fixed to the reinforcement units.

14 Claims, 23 Drawing Sheets

REINFORCEMENT CAGE FOR END MEMBER OF SHEAR WALL, JIG FOR MAKING REINFORCEMENT CAGE AND METHOD FOR MAKING REINFORCEMENT CAGE

BACKGROUND

1. Field of the Disclosure

The subject disclosure relates to a reinforcement cage, a jig for making the reinforcement cage and a method for making the reinforcement cage, in particular, where the reinforcement cage is used for an end member of a shear wall.

2. Description of Related Art

The complexity of a reinforcement cage's structure, which includes numerous interwoven stirrups, is widely recognized. This complexity presents challenges and difficulties in construction, necessitating skilled workers to ensure quality and efficiency. As a result, there is a growing demand within the industry for a reinforcement cage structure that offers adequate strength, as well as a systematic and efficient method for constructing purpose-specific reinforcement cages and their associated jigs.

SUMMARY

According to one example embodiment of the instant disclosure, a reinforcement cage includes a plurality of reinforcement units, disposed along a first direction, and a plurality of main bars. Each of the reinforcement units includes a first stirrup, which is substantially rectangular, at least one second stirrup and at least one third stirrup. The first stirrup includes a first side, a second side, a third side and a fourth side, wherein the first side is opposite to the third side, and the second side is opposite to the fourth side. The at least one second stirrup is configured to be connected to the first side and the third side of the first stirrup. The at least one three stirrup is configured to be connected to the second side and the fourth side of the first stirrup and be substantially perpendicular to and fixed to the at least one second stirrup. The main bars extend along the first direction, through the plurality of reinforcement units, and are fixed to the first side, the second side, the third side and the fourth side of the first stirrup of each of the plurality of reinforcement units.

According to another example embodiment of the instant disclosure, a jig includes a first side; a plurality of first positioning elements, arranged on the first side and being movable along the first side; a plurality of first holding elements, arranged on the first side and configured to be driven to move along the first side and relative to the first positioning elements; a second side, adjacent to the first side; a plurality of second positioning elements, arranged on the second side and being movable along the second side; a plurality of second holding elements, arranged on the second side and configured to be driven to move along the second side and relative to the second positioning elements; a third side, opposite to the first side; a plurality of third positioning elements, arranged on the third side and being movable along the third side; a plurality of third holding elements, arranged on the third side and configured to be driven to move along the third side and relative to the third positioning elements; a fourth side, opposite to the second side; a plurality of fourth positioning elements, arranged on the fourth side and being movable along the fourth side; and a plurality of fourth holding elements, arranged on the fourth side and configured to be driven to move along the fourth side and relative to the fourth positioning elements.

According to another example embodiment of the instant disclosure, the method for making a reinforcement cage includes: providing a jig; providing a substantially rectangular first stirrup, which comprises a first side, a second side, a third side and a fourth side, wherein the first side is opposite to the third side, and the second side is opposite to the fourth side; placing the first stirrup around outer edges of the first side, the second side, the third side and the fourth side of the jig; providing a plurality of second stirrups, wherein each of the second stirrups is a substantially rectangular structure formed by bending a single steel bar; placing two ends of each of the second stirrups at the first side and the third side of the jig, so that the second stirrups are connected to the first side and the third side of the first stirrup, wherein the second stirrups are arranged in parallel; providing a plurality of third stirrups, wherein each of the third stirrups is a substantially rectangular structure formed by bending a single steel bar; placing two ends of each of the third stirrups at the second side and the fourth side of the jig, so that the third stirrups are connected to the second side and the fourth side of the first stirrup; operating the first adjustment mechanism, the second adjustment mechanism, the third adjustment mechanism and/or the fourth adjustment mechanism of the jig, so that the first stirrup, the second stirrups and the third stirrups are adjusted to predetermined positions and fix the first stirrup, the second stirrups and the third stirrups to each other to form a reinforcement unit.

The foregoing has outlined rather broadly the features and technical advantages of the present disclosure so that the detailed description of the disclosure that follows may be better understood. Additional features and advantages of the disclosure will be described hereinafter, and form the subject of the claims of the disclosure. It should be appreciated by those skilled in the art that the conception and specific embodiment disclosed may be readily utilized as a basis for modifying or designing other structures or processes for carrying out the same purposes of the present disclosure. It should also be realized by those skilled in the art that such equivalent constructions do not depart from the spirit and scope of the disclosure as set forth in the appended claims.

BRIEF DESCRIPTION OF THE DRAWINGS

Aspects of some embodiments of the present disclosure are readily understood from the following detailed description when read with the accompanying figures. It should be noted that various structures may not be drawn to scale, and dimensions of the various structures may be arbitrarily increased or reduced for clarity of discussion.

DETAILED DESCRIPTION

Figure 1A:
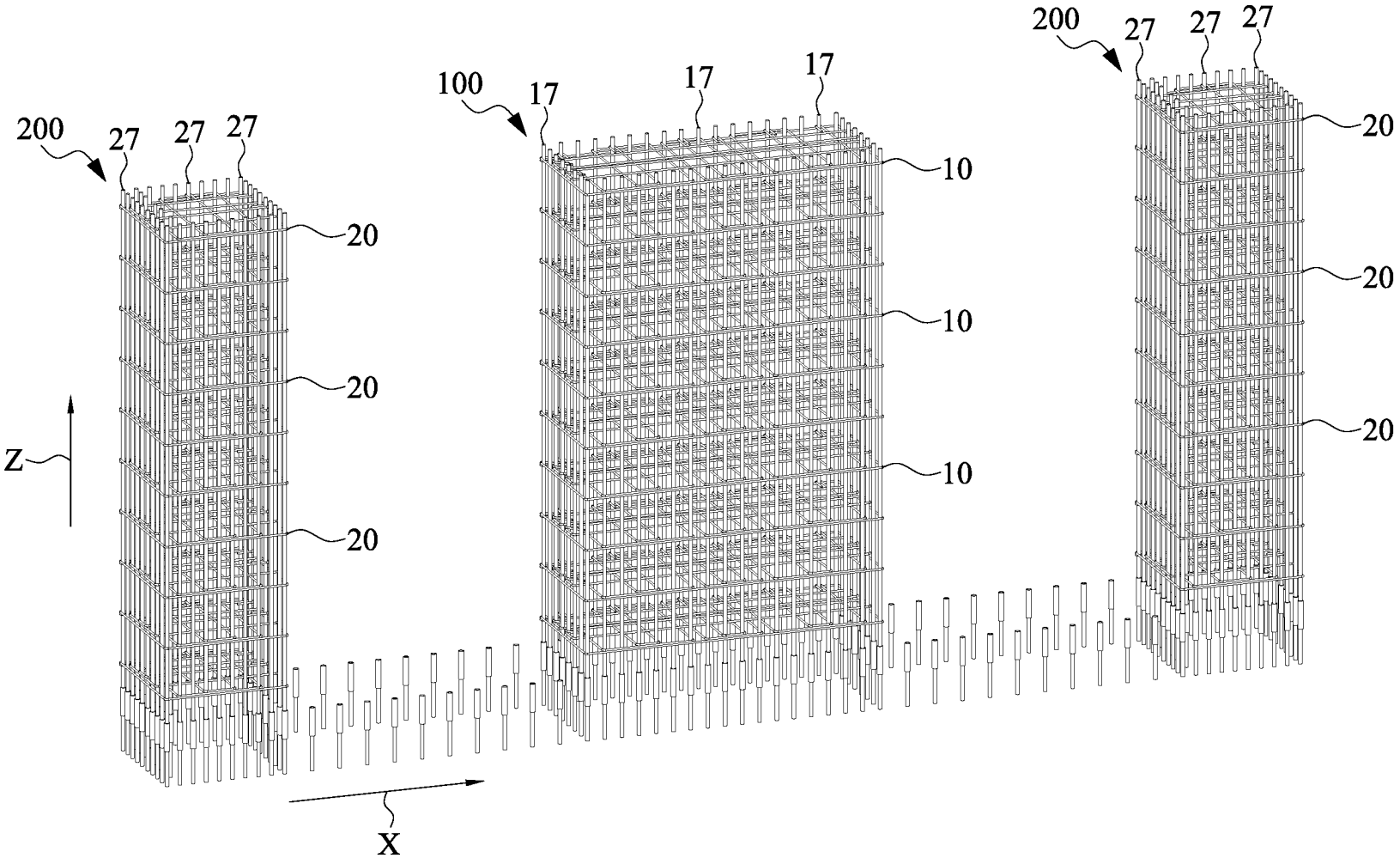
FIG. 1A is a schematic perspective view of a reinforcement cage, as assembled in accordance with one embodiment of the present disclosure.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath." "below," "lower," "above." "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be Interpreted accordingly.

It should be understood that, although the terms first, second, etc., may be used herein to describe various elements, these elements should not be limited by these terms. Unless indicated otherwise, these terms are only used to distinguish one element from another element.

As used herein, the terms "approximately." "substantially." "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a range of variation less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, two numerical values can be deemed to be "substantially" the same as or equal if a difference between the values is less than or equal to ±10% of an average of the values, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%.

FIG. 1A is a schematic perspective view of reinforcement cages 100, 200, as assembled in accordance with one embodiment of the present disclosure. As shown in FIG. 1A, a reinforcement cage 100 and two reinforcement cages 200 are positioned on the construction site for a shear wall. The reinforcement cages 200 are spaced apart at a predetermined distance from lateral sides of the reinforcement cage 100 in the X-direction. In some embodiments of the present disclosure, the reinforcement cage 100 and reinforcement cages 200 are constructed for end structural members of a shear wall. Furthermore, on the construction site, shear walls (not shown) are formed between and connected to the end structural members (not shown) containing reinforcement cage 100 and reinforcement cages 200 in the X-direction.

In some embodiments of the present disclosure, the reinforcement cage 100 includes a plurality of reinforcement units 10 and a plurality of main bars 17. Referring to FIG. 1A, the multiple reinforcement units 10 are arranged parallel to each other substantially along a Z-direction, while the main bars 17 extend substantially along the Z-direction and are connected and fixed to the reinforcement units 10.

Figure 1B:
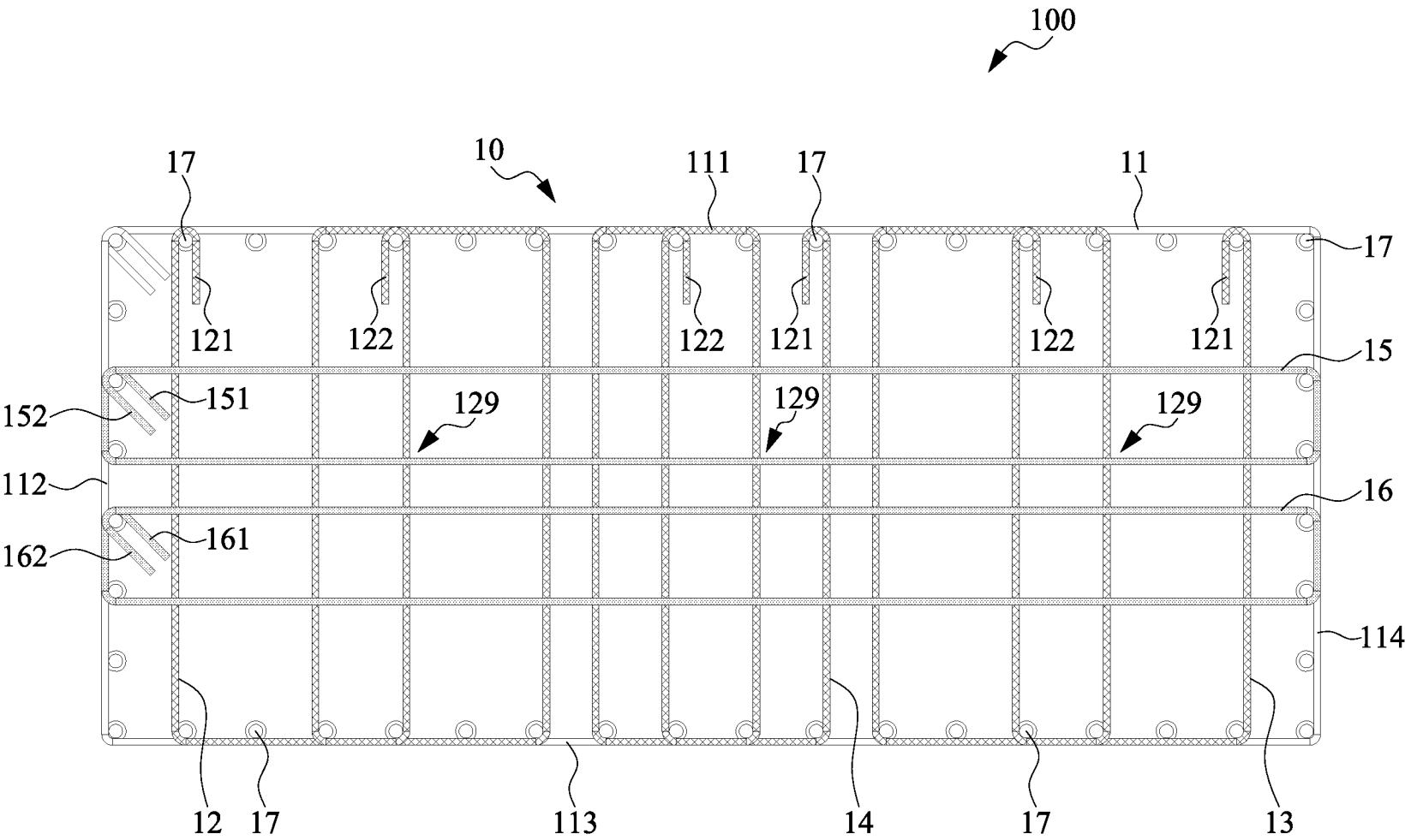
FIG. 1B is a schematic plan view of a reinforcement cage in accordance with one embodiment of the present disclosure.

FIG. 1B is a schematic plan view of a reinforcement cage 100 in accordance with one embodiment of the present disclosure. As shown in FIG. 1B, the reinforcement cage 100 includes stirrups 11, 12, 13, 14, 15 and 16. In some embodiments of the present disclosure, the stirrup 11 is generally rectangular in shape, comprising interconnecting sides 111, 112, 113, and 114, where sides 111 and 113 are opposite each other, and sides 112 and 114 are also opposite each other. In some embodiments of the present disclosure, the stirrup 11 forms the outer contour of the reinforcement unit 10 and substantially defines the size and shape of the reinforcement unit 10. In some embodiments of the present disclosure, the side 111 or 113 of the stirrup 11 is approximately 2400 mm, and the side 112 or 114 of the stirrup 11 is approximately 1200 mm. Thus, the overall shape of the reinforcement unit 10 is approximately rectangular, with dimensions of about 2400 mm×1200 mm. Furthermore, the cross-section of the end structural member of the shear wall to be made from reinforcement cage 100 is also approximately rectangular, with its cross-sectional dimensions being roughly 2400 mm×1200 mm as well.

As shown in FIG. 1B, the stirrups 12, 13, 14 are configured to respectively connect the sides 111 and 113 of the stirrup 11, while the stirrups 15, 16 are configured to connect the sides 112 and 114 of the stirrup 11. In some embodiments of the present disclosure, the extension direction of the stirrup 15 or 16 is generally perpendicular to the extension direction of stirrup 12, 13, or 14, and stirrup 15 and stirrup 16 are fixed onto stirrup 12, 13, and/or 14.

Referring to FIG. 1B again, the plurality of main bars 17 are placed on or close to the sides 111, 112, 113, and 114 of the stirrup 11 and are fixed to the reinforcement unit 10 through these sides. In some embodiments of the present disclosure, the stirrup 12, 13, or 14 is configured to surround the at least two main bars 17 on or adjacent to the side 111 of the stirrup 11 and the at least two main bars 17 adjacent to the side 113 of the stirrup 11. In some embodiments of the present disclosure, the stirrup 15 or 16 is configured to surround the at least two main bars 17 on or adjacent to the side 112 of the stirrup 11 and the at least two main bars 17 on or adjacent to the side 114 of the stirrup 11.

In some embodiments of the present disclosure, the reinforcement cage 200 includes a plurality of reinforcement units 20 and a plurality of main bars 27. Referring to FIG. 1A, the reinforcement units 20 are arranged parallel to each other substantially along the Z-direction, and the main bars 27 extend substantially along the Z-direction, connecting and fixing to the multiple reinforcement units 20.

Figure 1C:
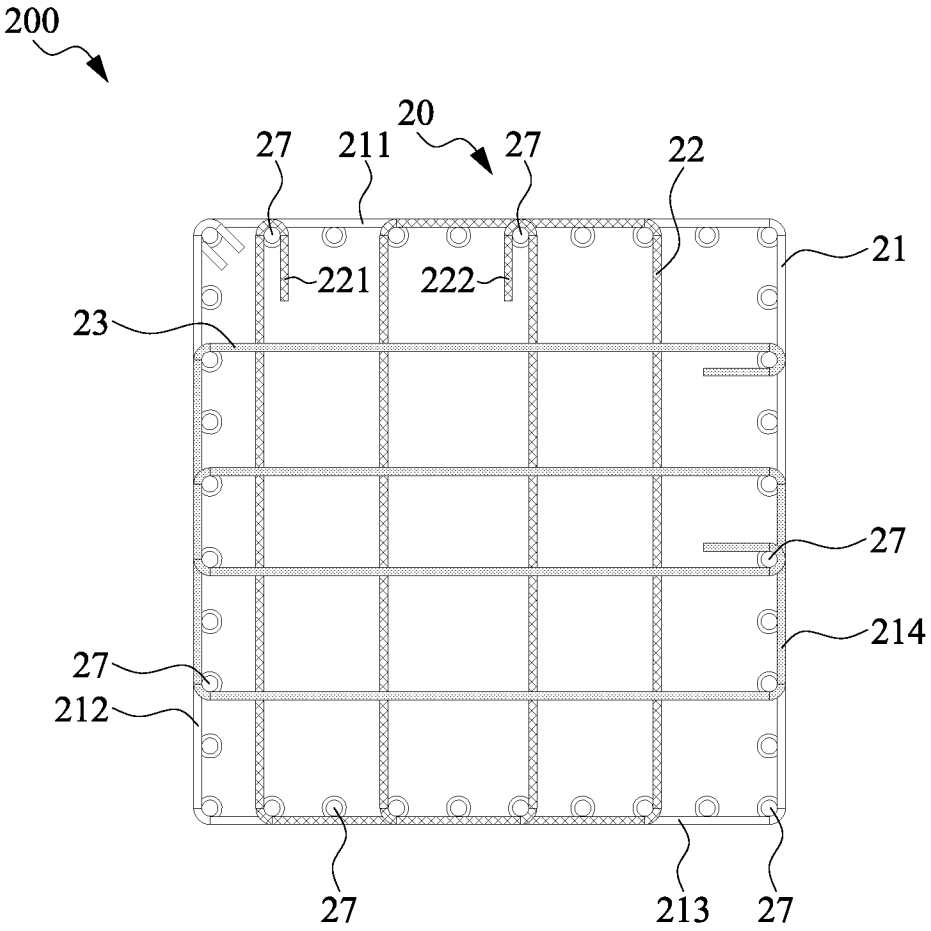
FIG. 1C is a schematic plan view of a reinforcement cage in accordance with one embodiment of the present disclosure.

FIG. 1C is a schematic plan view of a reinforcement cage 200 in accordance with one embodiment of the present disclosure. Referring to FIG. 1C, the reinforcement unit 20 includes stirrups 21, 22, 23. In some embodiments of the present disclosure, the stirrup 21 is substantially rectangular and has sides 211, 212, 213, and 214, where the sides 211 and 213 are opposite each other, and the sides 212 and 214 are opposite each other. In some embodiments of the present disclosure, the stirrup 21 forms the outer contour of the reinforcement unit 20 and substantially defines the size and shape of the reinforcement unit 20. In some embodiments of the present disclosure, the side 211 or 213 of stirrup 21 is approximately 1250 mm, and the side 212 or 214 of stirrup 21 is approximately 1200 mm. Thus, the overall shape of the reinforcement unit 20 is substantially rectangular, with dimensions of about 1250 mm×1200 mm. Furthermore, the cross-section of the end structural member of the shear wall to be made from reinforcement cage 200 is also approximately rectangular, with its cross-sectional dimensions being substantially 1250 mm×1200 mm as well.

As shown in FIG. 1C, the stirrup 22 is configured to connect the sides 211 and 213 of stirrup 21, and the stirrup 23 is configured to connect the sides 212 and 214 of the stirrup 21. In some embodiments of the present disclosure, the stirrup 22 is substantially overlapped with the stirrup 23 in the Z-direction. In some embodiments of the present disclosure, the stirrup 22 is configured to surround the at least two main bars 27 on or adjacent to the side 211 of the stirrup 21 and the at least two main bars 27 on or adjacent to the side 213 of the stirrup 21. In some embodiments of the present disclosure, the stirrup 23 is configured to surround the at least two main bars 27 on or adjacent to the side 212 of the stirrup 21 and the at least two main bars 27 on or adjacent to the side 214 of the stirrup 21.

Referring to FIG. 1C again, the main bars 27 are disposed along the inner surfaces of the sides 211, 212, 213, and 214 of stirrup 21 and are fixed to the reinforcement unit 20 through these sides.

Figure 2A:
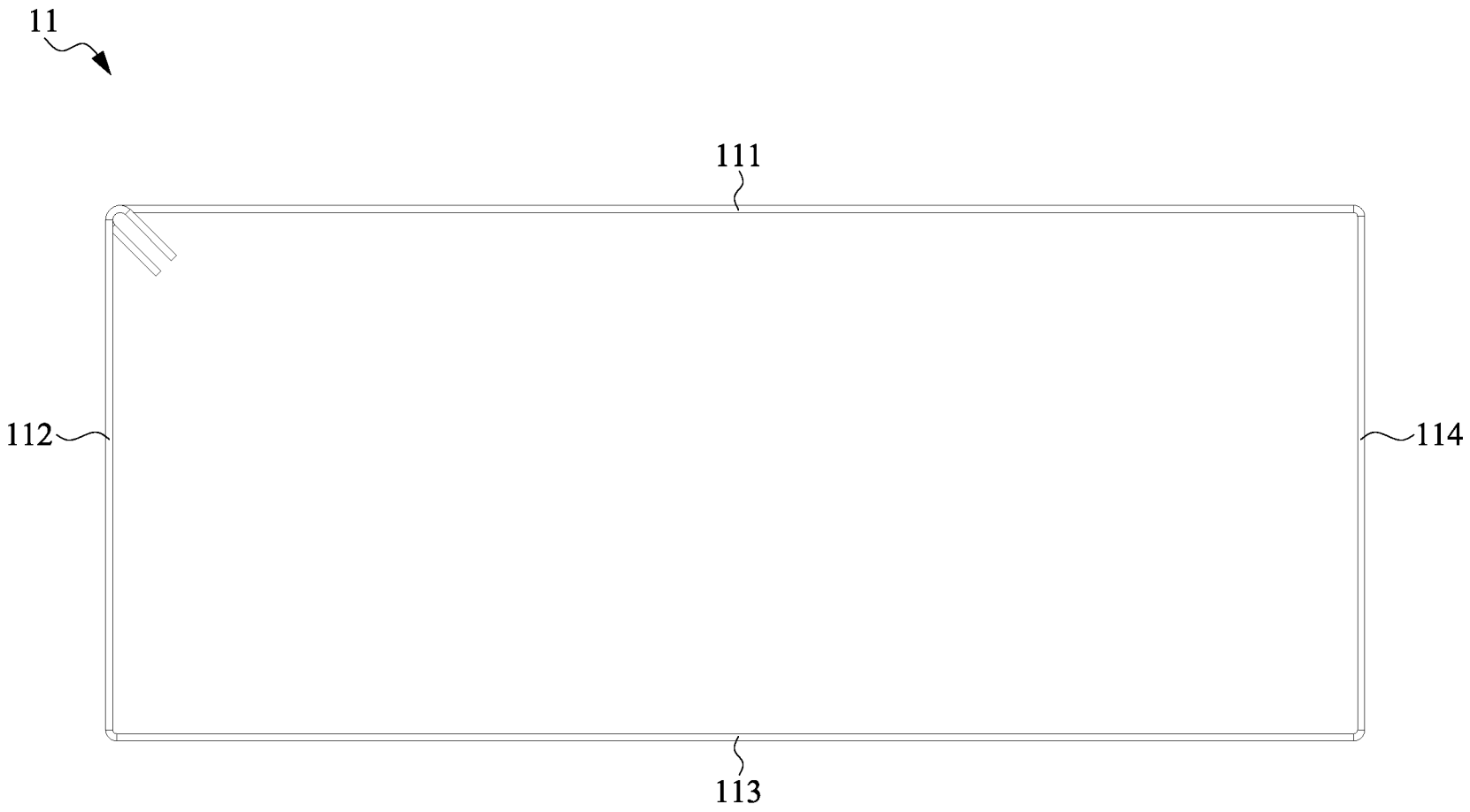
FIG. 2A is a schematic view of a stirrup of a reinforcement unit in accordance with one embodiment of the present disclosure.

FIG. 2A is a schematic view of the stirrup 11 of the reinforcement unit 10 in accordance with one embodiment of the present disclosure. As shown in FIG. 2A, the stirrup 11 is substantially rectangular, and comprises sides 111, 112, 113, and 114. The sides 111 and 113 are opposite each other, and so are the sides 112 and 114. In some embodiments of the present disclosure, the extension direction of the side 111 is substantially parallel to the extension direction of the side 113; similarly, the extension direction of the side 112 is substantially parallel to the extension direction of the side 114. In some embodiments of the present disclosure, the extension direction of the side 111 is generally perpendicular to the extension direction of the side 112 or 114, and similarly, the extension direction of the side 113 is substantially perpendicular to the extension direction of the side 112 or 114. In some embodiments, the stirrup 11 is formed by bending a single steel bar and the sides 111, 112, 113, and 114 of stirrup 11 are integrally formed.

Figure 2B:
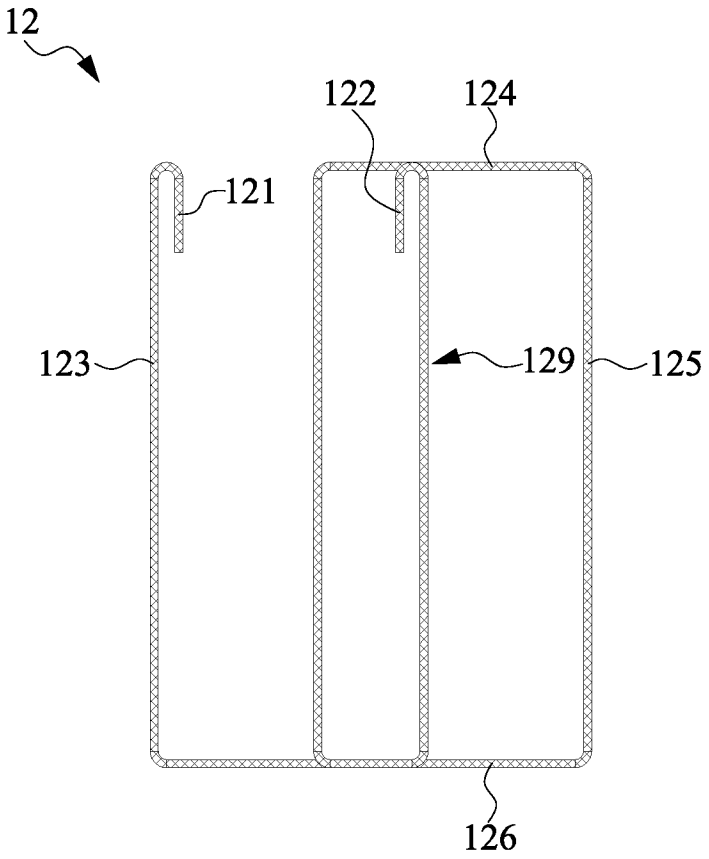
FIG. 2B is a schematic view of a stirrup of a reinforcement unit in accordance with one embodiment of the present disclosure.

FIG. 2B is a schematic view of the stirrup 12 of the reinforcement unit 10 in accordance with one embodiment of the present disclosure. As shown in FIG. 2B, the stirrup 12 is substantially formed by bending a single steel bar into a substantially rectangular shape. The bent single steel bar has two ends, each featuring a hook-like end part, 121 and 122. The bending of the single steel bar forms the sides 123, 124, 125, and 126 of the stirrup 12, along with an elongated rectangular structure 129 within it. The sides 123 and 125 are opposite each other, as are the sides 124 and 126. The elongated rectangular structure 129 is positioned between the sides 123 and 125 and is connected to the sides 124 and 126. In some embodiments of the present disclosure, the hook-shaped end part 121 is connected to the side 123 and located at one corner of the rectangular structure of stirrup 12, bending towards the inside of the stirrup 12. In some embodiments of the present disclosure, the hook-shaped end part 122 is positioned within the elongated rectangular structure 129, and the bending direction of the hook-shaped end part 122 is opposite to that of the hook-shaped end part 121. In some embodiments of the present disclosure, the structure of stirrup 13 and/or 14 is substantially the same as or similar to the structure of stirrup 12. Referring to FIG. 1B, the hook-shaped end parts 121 and 122 of stirrup 12 are configured to substantially hook onto the main bars 17 that are surrounded by and on or adjacent to side 111 of stirrup 11.

Figure 2C:
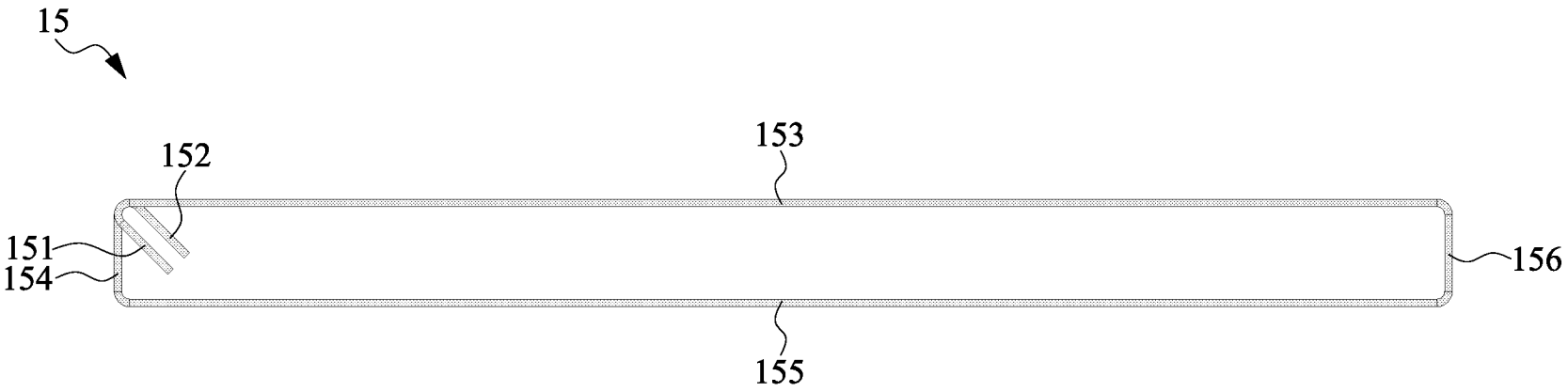
FIG. 2C is a schematic view of a stirrup of a reinforcement unit in accordance with one embodiment of the present disclosure.

FIG. 2C is a schematic view of a stirrup 15 of a reinforcement unit 10 in accordance with one embodiment of the present disclosure. As shown in FIG. 2C, the stirrup 15 is substantially formed by bending a single steel bar into an elongated rectangular structure. The bent single steel bar has two ends, each with a hook-shaped end part, 151 and 152. The bending of the single steel bar forms the sides 153, 154, 155, and 156 of the stirrup 15. The sides 153 and 155 are opposite each other, as are the sides 154 and 156. In some embodiments of the present disclosure, the hook-shaped end part 151 is connected to side 153 and is located at one corner of the rectangular structure of the stirrup 15, bending towards the inside of the stirrup 15. In some embodiments of the present disclosure, the hook-shaped end part 152 is connected to the side 154 and is located at the same corner of the rectangular structure of the stirrup 15, adjacent to the hook-shaped end part 151, and bends towards the inside of the stirrup 15. In some embodiments of the present disclosure, the structure of the stirrup 16 is substantially the same as or similar to the structure of the stirrup 15.

Further, as illustrated in FIG. 1B, the hook-shaped end parts 151 and 152 of the stirrup 15 are configured to hook onto the main bars 17 that are surrounded by and on or adjacent to the side 112 of the stirrup 11. In some embodiments of the present disclosure, the hook-shaped end parts 151 and 152 of the stirrup 15 are configured to hook onto the main bars 17 that are surrounded by and on or adjacent to the side 114 of the stirrup 11.

Figure 2D:
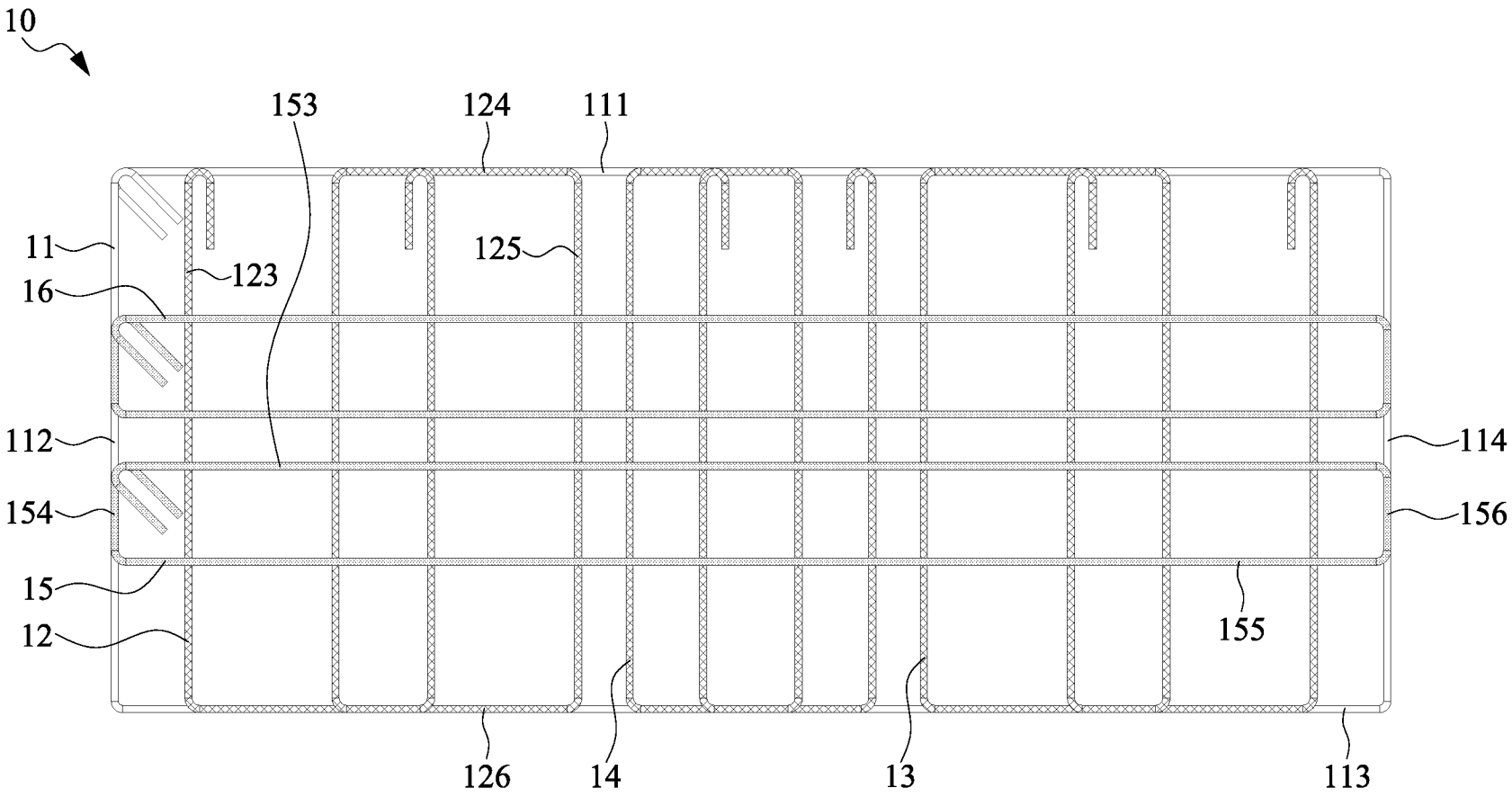
FIG. 2D is a schematic view of a reinforcement unit in accordance with one embodiment of the present disclosure.

FIG. 2D is a schematic view of the reinforcement unit 10 in accordance with one embodiment of the present disclosure. FIG. 2D discloses the reinforcement unit 10 composed collectively of the stirrups 11, 12, 13, 14, 15, and 16. As shown in FIG. 2D, the stirrups 12, 13, and 14 connect to the sides 111 and 113 of the stirrup 11. In some embodiments of the present disclosure, the sides 123 and 125 of the stirrup 12 are substantially perpendicular to the sides 111 and 113 of the stirrup 11, while the sides 124 and 126 of the stirrup 12 substantially overlap with the sides 111 and 113 of the stirrup 11. In some embodiments, the stirrup 14 is positioned between the stirrups 12 and 13, and the width of the stirrup 14 is smaller than the width of either stirrup 12 or stirrup 13. In some embodiments, the stirrups 12 and 13 are positioned in a symmetrical arrangement.

In some embodiments, the stirrups 15 and 16 connect to the sides 112 and 114 of the stirrup 11. In some embodiments of the present disclosure, the sides 153 and 155 of the stirrup 15 are substantially parallel to the sides 111 and 113 of the stirrup 11. In some embodiments of the present disclosure, the sides 153 and 155 of the stirrup 15 are substantially perpendicular to the sides 123 and 125 of the stirrup 12.

Figure 3A:
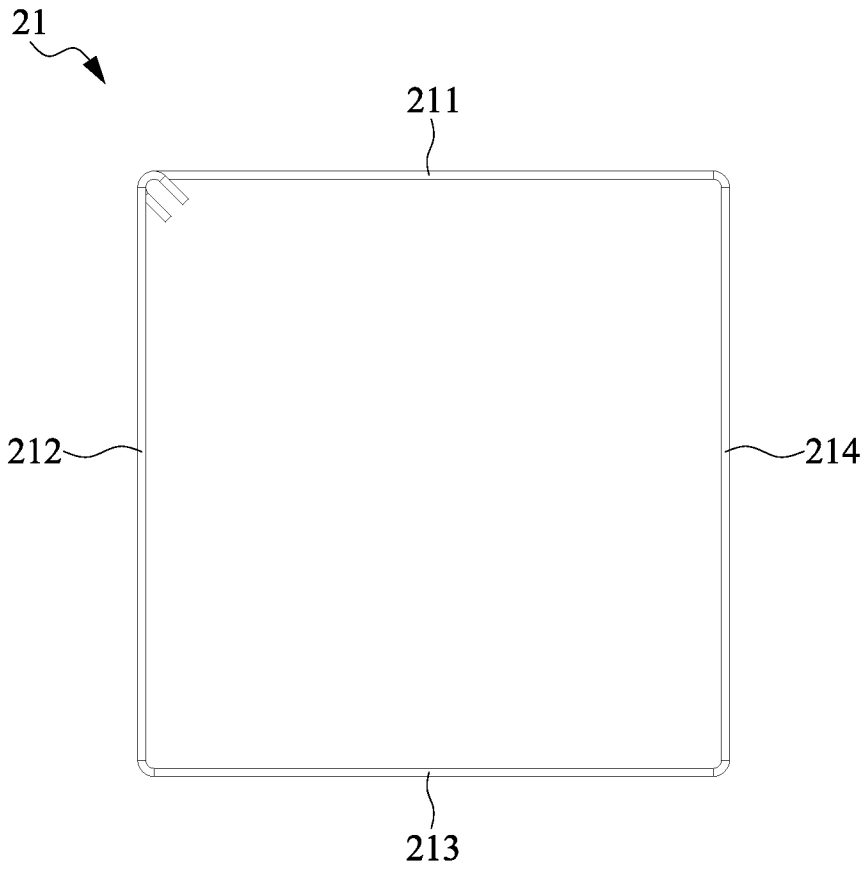
FIG. 3A is a schematic view of a stirrup of a reinforcement unit in accordance with one embodiment of the present disclosure.

FIG. 3A is a schematic view of the stirrup 21 of the reinforcement unit 20 in accordance with one embodiment of the present disclosure. As shown in FIG. 3A, the stirrup 21 is substantially rectangular in shape and has sides 211, 212, 213, and 214. The sides 211 and 213 are opposite each other, as are the sides 212 and 214. In some embodiments of the present disclosure, the extension direction of the side 211 is substantially parallel to the extension direction of the side 213; similarly, the extension direction of the side 212 is substantially parallel to the extension direction of the side 214. Additionally, in some embodiments, the extension direction of the side 211 is substantially perpendicular to the extension directions of the sides 212 or 214, and the extension direction of the side 213 is substantially perpendicular to the extension directions of the sides 212 or 214. In some embodiments, the stirrup 21 is formed by bending a single steel bar and the sides 211, 212, 213, and 214 of the stirrup 21 are integrally formed.

Figure 3B:
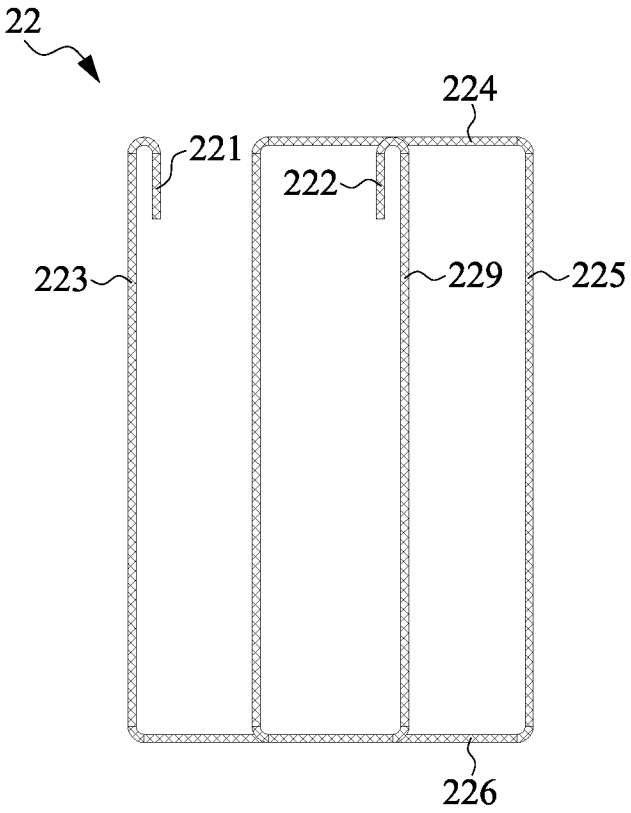
FIG. 3B is a schematic view of a stirrup of a reinforcement unit in accordance with one embodiment of the present disclosure.

FIG. 3B is a schematic view of the stirrup 22 of the reinforcement unit 20 in accordance with one embodiment of the present disclosure. As shown in FIG. 3B, the stirrup 22 is substantially formed by bending a single steel bar into a substantially rectangular shape. The bent single steel bar has two ends, each with a hook-shaped end part, 221 and 222. The bending of the single steel bar forms the sides 223, 224, 225, and 226 of the stirrup 22, along with an elongated rectangular structure 229 within it. The sides 223 and 225 are opposite each other, as are the sides 224 and 226. The elongated structure 229 is positioned between the sides 223 and 225 and is connected to the sides 224 and 226. In some embodiments of the present disclosure, the hook-shaped end part 221 is connected to the side 223 of the stirrup 22, located at one corner of the rectangular structure of the stirrup 22, and bends towards the inside of the stirrup 22. In some embodiments, the hook-shaped end part 222 is located within the elongated rectangular structure 229, and the bending direction of the hook-shaped end part 222 is opposite to that of the hook-shaped end part 221. In some embodiments, the structure of the stirrup 23 is substantially the same as or similar to that of the stirrup 22.

Furthermore, as shown in FIG. 1C, the hook-shaped end parts 221 and 222 of the stirrup 22 are configured to hook onto the main bars 27 that are surrounded by and on or adjacent to the side 211 of the stirrup 21. Additionally, the hook-shaped end parts of the stirrup 23 are configured to hook onto the main bars 27 that are surrounded by and on or adjacent to the side 214 of the stirrup 21.

Figure 3C:
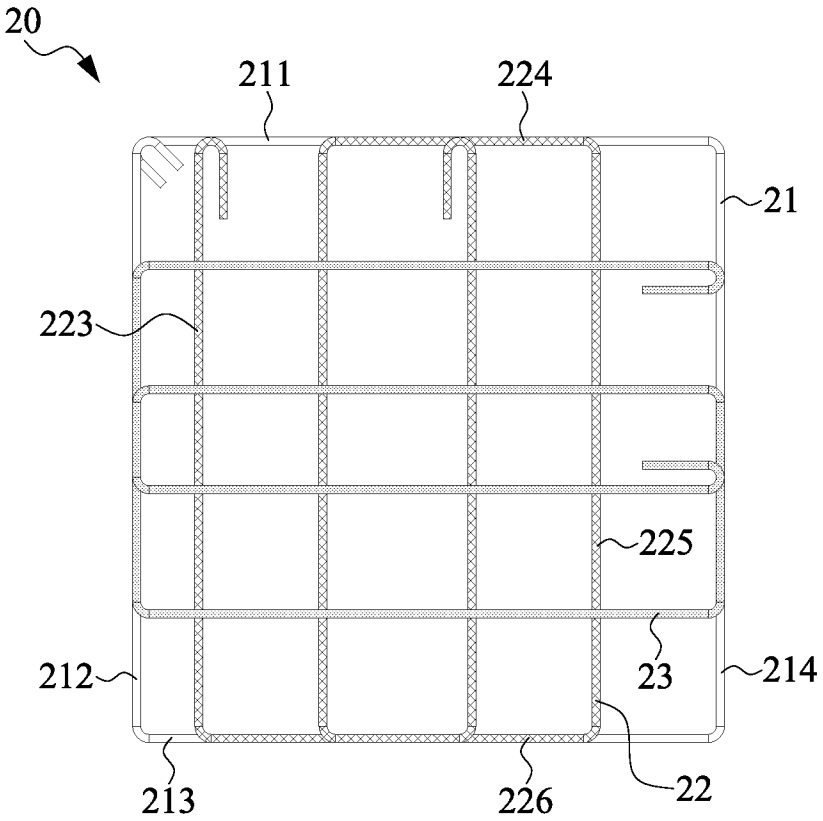
FIG. 3C is a schematic view of a reinforcement unit in accordance with one embodiment of the present disclosure.

FIG. 3C is a schematic view of a reinforcement unit 20 in accordance with one embodiment of the present disclosure. FIG. 3C discloses the reinforcement unit 20, which is composed collectively of the stirrups 21, 22, and 23. As shown in FIG. 3C, the stirrup 22 connects the sides 211 and 213 of the stirrup 21, and the stirrup 23 connects the sides 212 and 214 of the stirrup 21. In some embodiments of the present disclosure, the sides 223 and 225 of the stirrup 22 are substantially perpendicular to the sides 211 and 213 of the stirrup 21, while the sides 224 and 226 of the stirrup 22 substantially overlap with the sides 211 and 213 of the stirrup 21. In some embodiments, the stirrup 23 has a structure identical to that of stirrup 22 and is positioned with a 90-degree rotation relative to stirrup 22.

Figure 4:
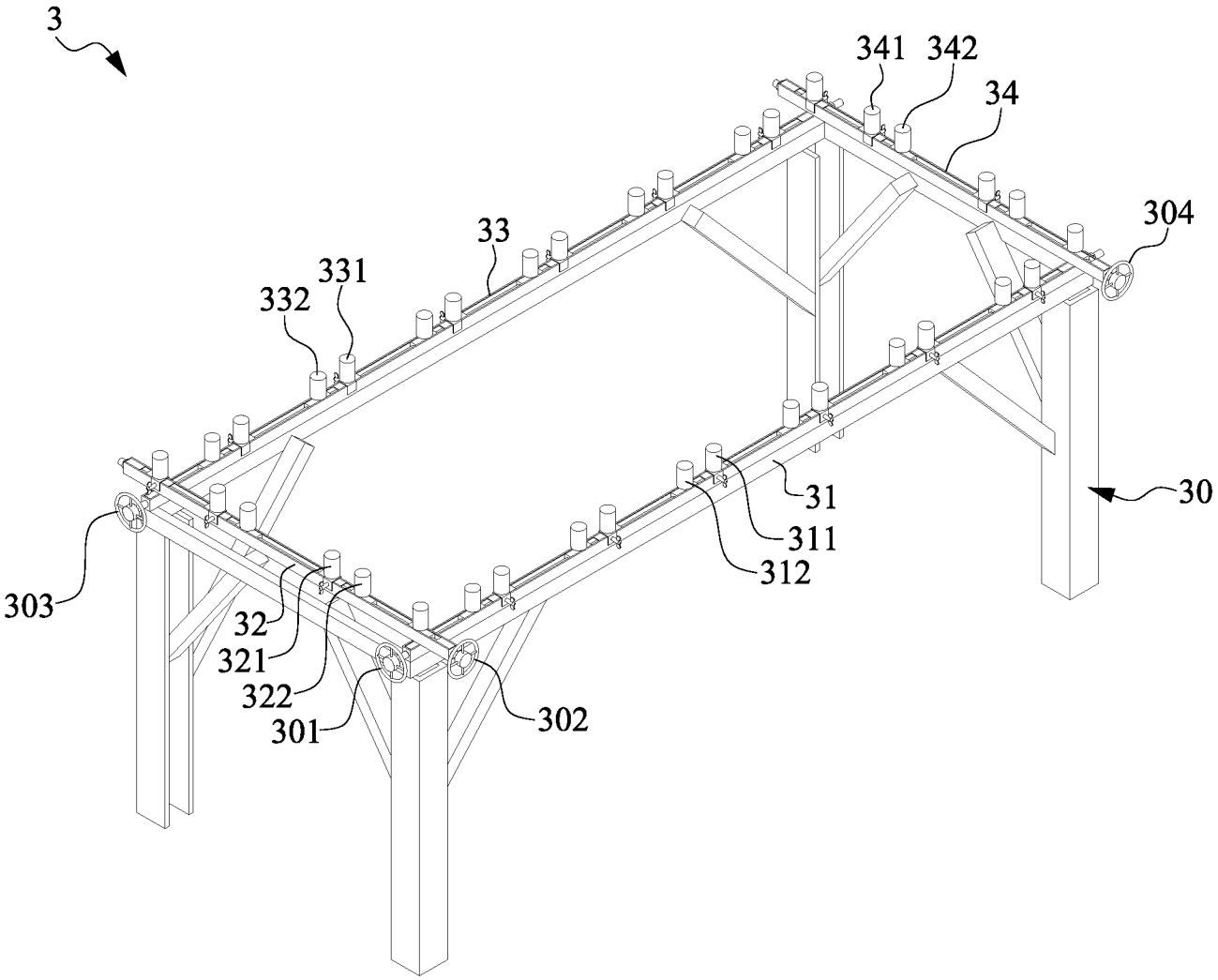
FIG. 4 is a schematic view of a jig in accordance with one embodiment of the present disclosure.

FIG. 4 is a schematic view of a jig 3 in accordance with one embodiment of the present disclosure. In some embodiments of the present disclosure, the jig 3 is used to manufacture reinforcement units that are the same as or similar to reinforcement unit 10 or reinforcement unit 20.

As shown in FIG. 4, the jig 3 includes sides 31, 32, 33, 34 and a support structure 30 that supports these sides. The sides 31 and 33 are opposite each other, as are the sides 32 and 34. Additionally, the side 31 is next to the side 32, and the side 33 is next to the side 34. The support structure 30 is used to support these sides 31, 32, 33, 34, keeping them elevated from the ground.

In some embodiments of the present disclosure, on the side 31, there are a plurality of positioning elements 311 and a plurality of holding elements 312. The positioning elements 311 are configured to be movably positioned along the side 31, and the holding elements 312 are configured to be driven to move along the side 31 relative to the positioning elements 311. On the side 32, there are a plurality of positioning elements 321 and a plurality of holding elements 322. The positioning elements 321 are configured to be movably positioned along the side 32, and the holding elements 322 are configured to be driven to move along the side 32 relative to the positioning elements 321. On the side 33, there are a plurality of positioning elements 331 and a plurality of holding elements 332. The positioning elements 331 are configured to be movably positioned along the side 33, and the holding elements 332 are configured to be driven to move along the side 33 relative to the positioning elements 331. On the side 34, there are a plurality of positioning elements 341 and a plurality of holding elements 342.

The positioning elements 341 are configured to be movably positioned along the side 34, and the holding elements 342 are configured to be driven to move along the side 34 relative to the positioning elements 341. Additionally, the jig 3 further includes adjustment mechanisms 301, 302, 303, 304.

Figure 5A:
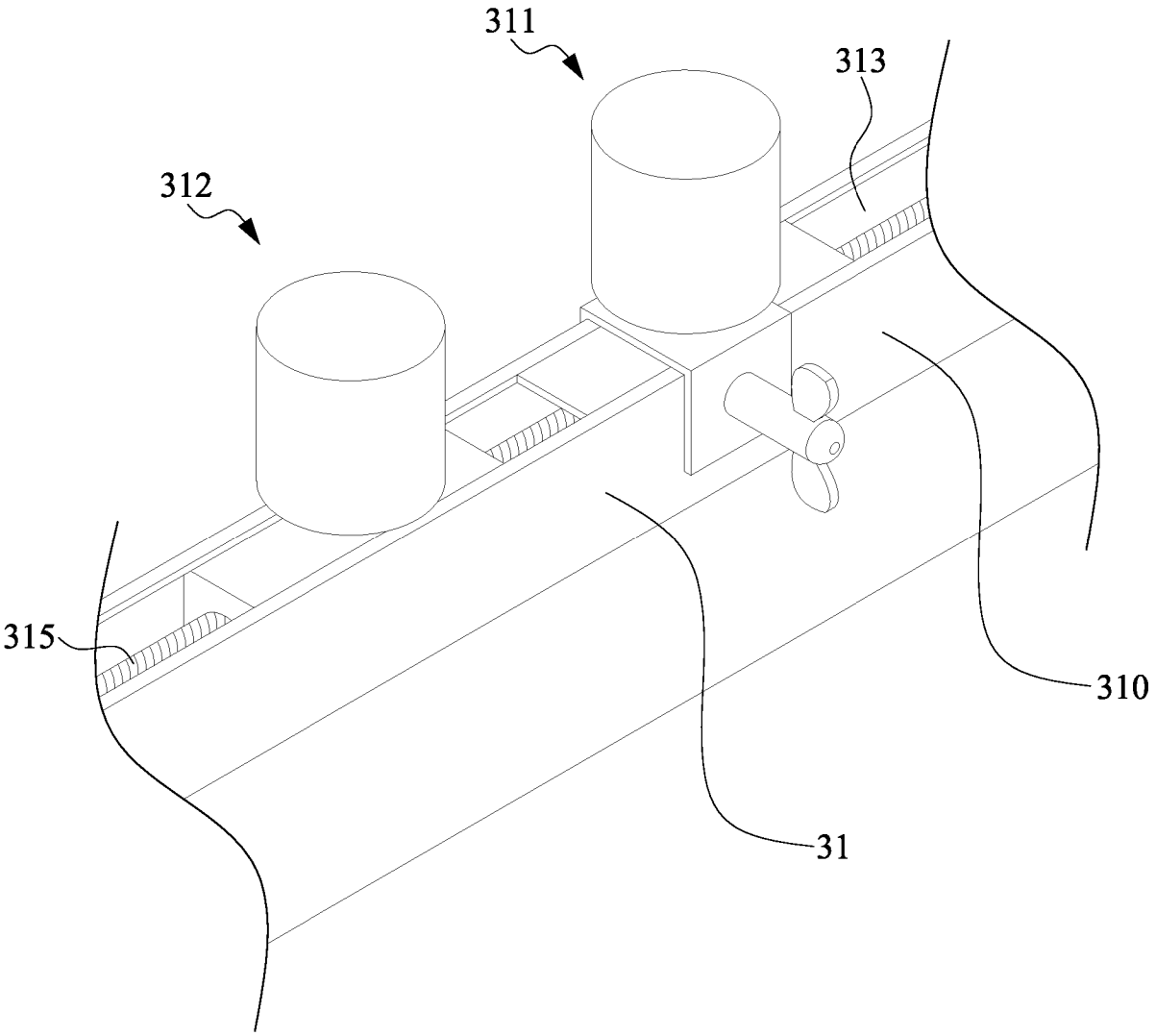
FIG. 5A is a schematic view of a part of a jig in accordance with one embodiment of the present disclosure.
Figure 5B:
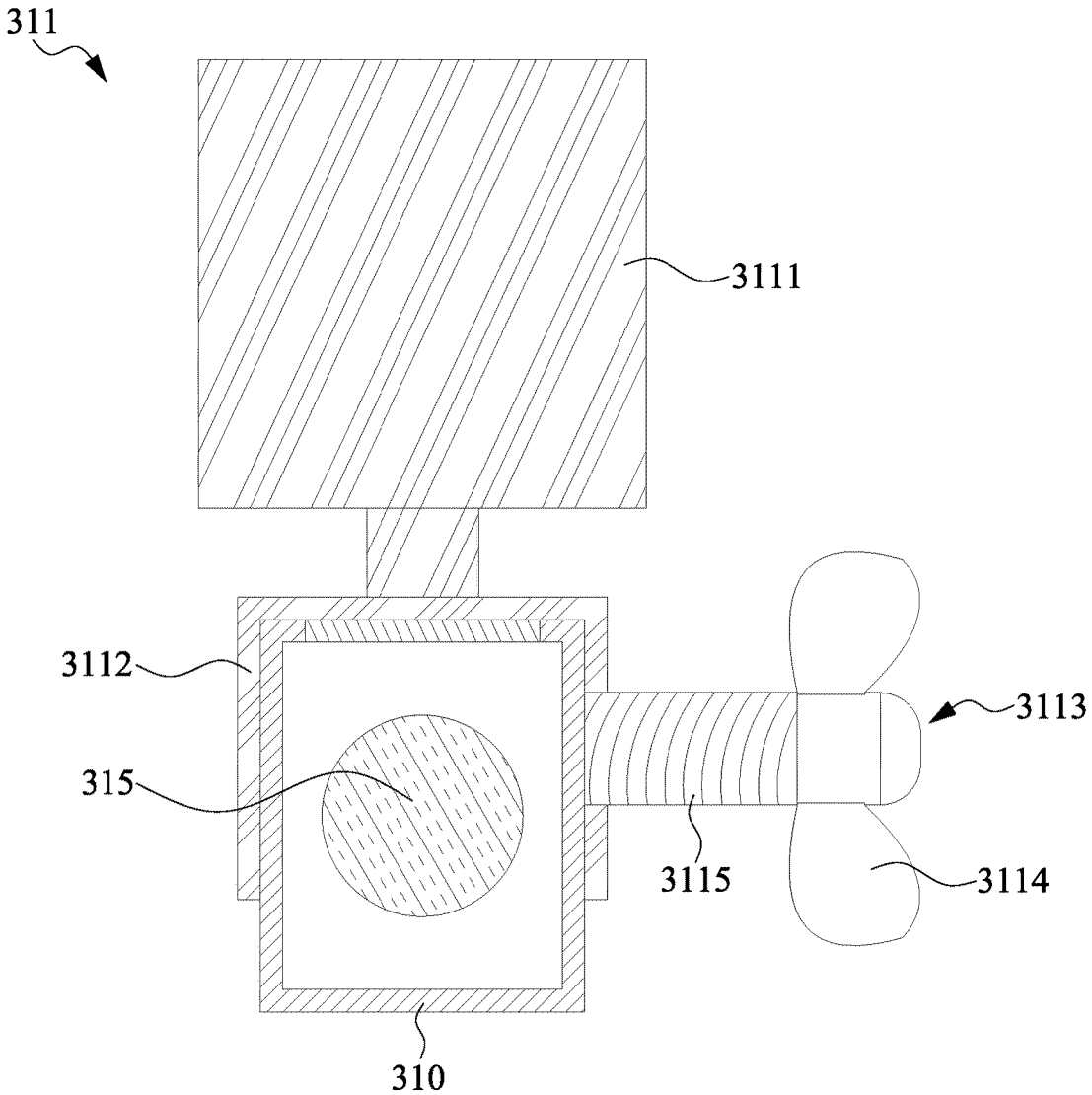
FIG. 5B is a schematic cross-sectional view of a part of a jig in accordance with one embodiment of the present disclosure.
Figure 5C:
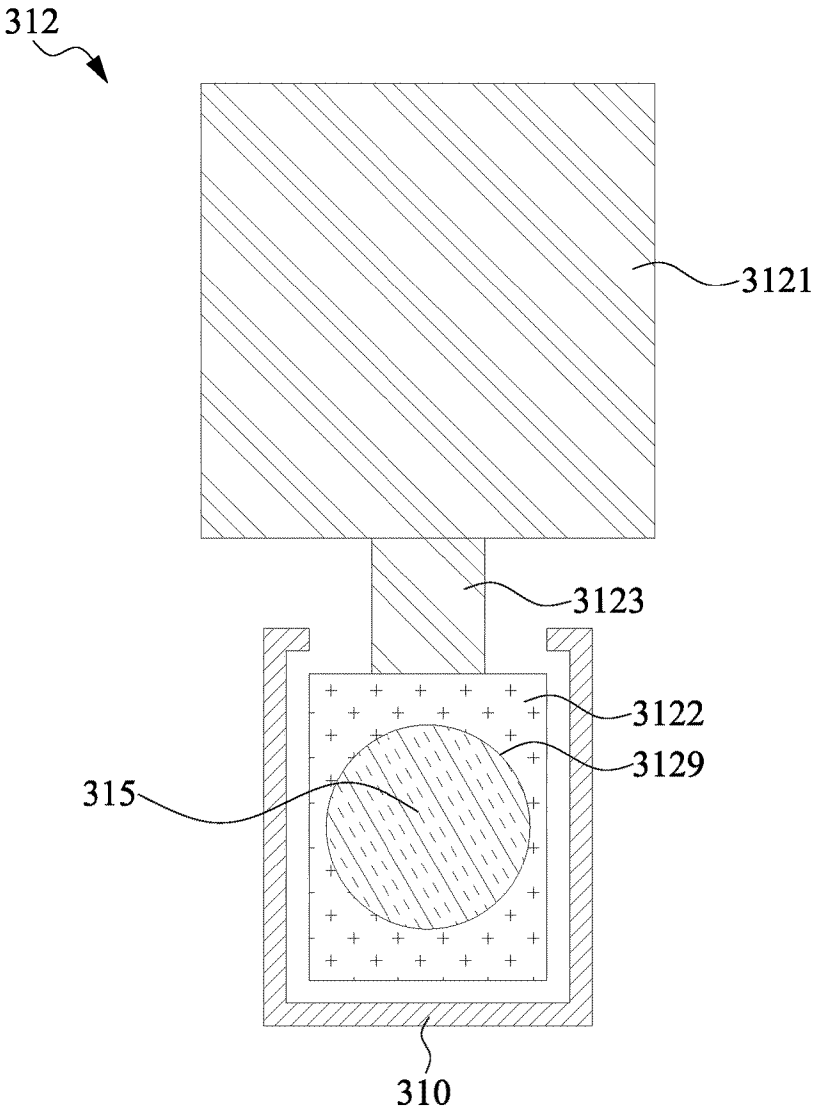
FIG. 5C is a schematic cross-sectional view of a part of a jig in accordance with one embodiment of the present disclosure.

FIG. 5A is a schematic view that discloses a portion of the side 31 of the jig 3 and the positioning element 311 and the holding element 312 placed on the side 31. FIG. 5B is a cross-sectional schematic view that discloses the positioning element 311 placed on the side 31. FIG. 5C is a cross-sectional schematic view that discloses the holding element 312 placed on side 31.

As shown in FIG. 5A, FIG. 5B and FIG. 5C, the side 31 includes a hollow, elongated body 310. The upper surface of this hollow, elongated body 310 has a groove 313, in which a screw 315 is installed. In some embodiments of the present disclosure, the screw 315 is configured to connect with the adjustment mechanism 301 (see FIG. 4).

Referring to FIG. 5A and FIG. 5B, the positioning element 311 includes a substantially cylindrical body 3111, a substantially inverted U-shaped frame 3112, and a locking component 3113. The body 3111 is situated on the frame 3112, which is capable of moving along the hollow, elongated body 310. When the frame 3112 moves along the hollow, elongated body 310, the body 3111 also moves along the hollow, elongated body 310, thereby causing the positioning member 311 to move along the side 31. The locking element 3113 is installed on the frame 3112 and has a threaded rod portion 3115 with a handle 3114 located at one end of the rod portion 3115. The rod portion 3115 passes through the frame 3112 in such a way that the other end (i.e., the free end) is located near one side wall of the hollow elongated body 310. The user can rotate the rod portion 3115 via the handle 3114 to make the free end either contact the side wall of the hollow elongated body 310 or move away from the side wall of the hollow elongated body 310. When the free end of the rod portion 3115 of the locking element 3113 is in contact with the side wall of the hollow elongated body 310, the positioning member 311 is fixed to the side 31 and is prevented from moving along the side 31. When the free end of the rod portion 3115 of the locking element 3113 is away from the side wall of the hollow elongated body 310, the positioning member 311 is able to move relative to and along the side 31.

Referring to FIG. 5C, the holding element 312 includes a substantially cylindrical body 3121, a carrier 3122 with a channel 3129 therein, and a connecting element 3123. The body 3121 is connected to the carrier 3122 through the connecting element 3123, and the rod 315 passes through the channel 3129 of the carrier 3122 to connect the holding element 312 to the rod 315 and is secured on the side 31. That is, the channel 3129 of the carrier 3122 is threaded and secured to the rod 315. The carrier 3122 can be driven by the rod 315, allowing the holding element 312 to move along the side 31.

In some embodiments of the present disclosure, the structure and relationship between the side 32 and the holding element 322 and positioning element 321 are similar to the structure and relationship between the side 31 and the holding element 312 and positioning element 311. In some embodiments of the present disclosure, the structure and relationship between the side 33 and the holding element 332 and positioning element 331 are similar to the structure and relationship between the side 31 and the holding element 312 and positioning element 311. In some embodiments of the present disclosure, the structure and relationship between the side 34 and the holding element 342 and positioning element 341 are similar to the structure and relationship between the side 31 and the holding element 312 and positioning element 311.

Figure 5D:
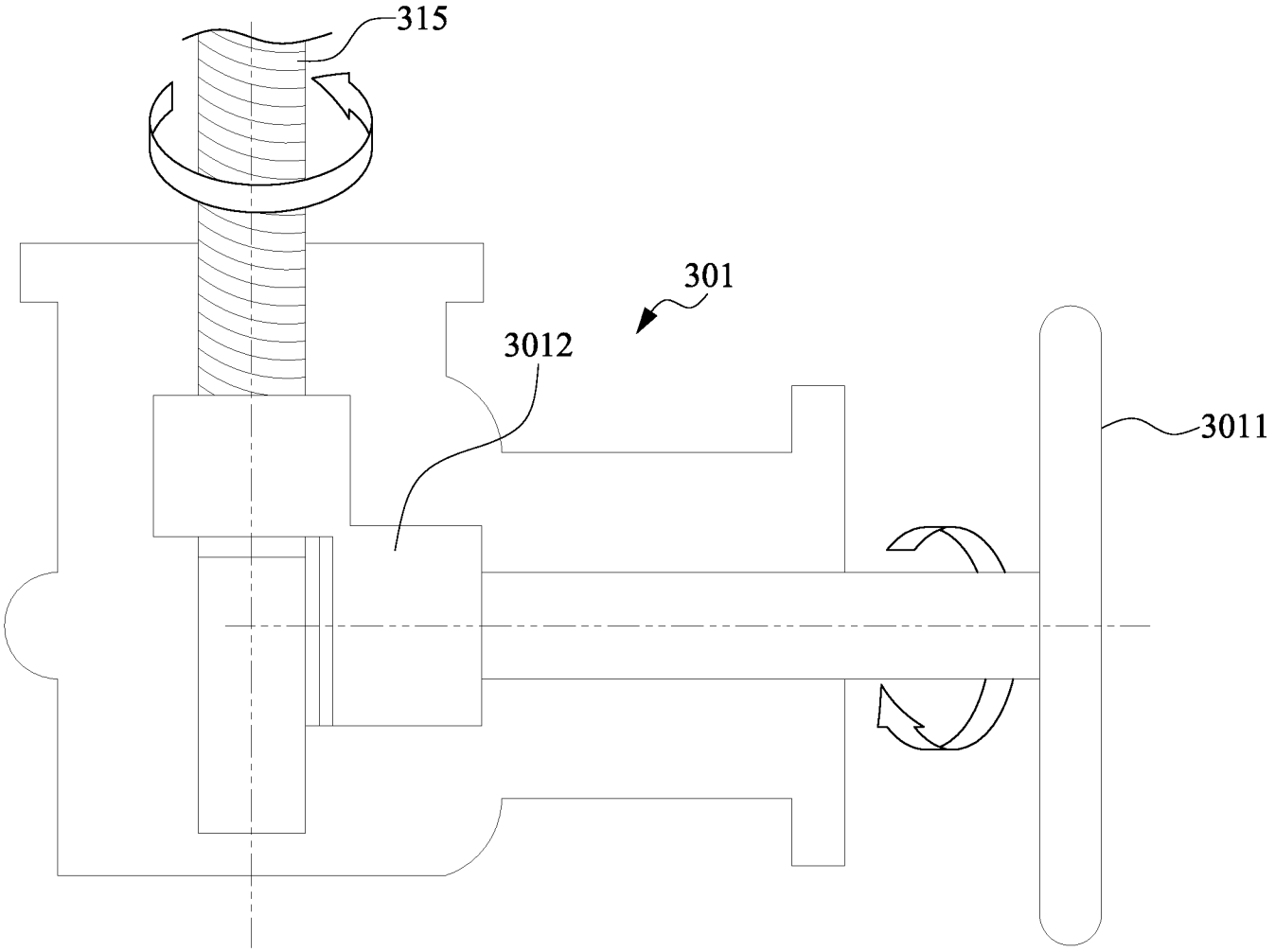
FIG. 5D is a schematic view of a part of a jig in accordance with one embodiment of the present disclosure.

FIG. 5D is a schematic view that discloses in one embodiment the adjustment mechanism 301 of the jig 3. The adjustment mechanism 301 is connected to the screw 315 on the side 31. The adjustment mechanism 301 includes a rotating handle 3011 and a ratchet mechanism 3012. The rotating handle 3011 of the adjustment mechanism 301 is connected to the ratchet mechanism 3012, and the ratchet mechanism 3012 is further connected to the screw 315. Users can rotate the rotating handle 3011 to drive the ratchet mechanism 3012, which, in turn, drives the screw 315 to move along the lengthwise direction of the hollow elongated body 310. This allows the holding element 312 connected to the screw 315 to move along the side 31. In the embodiment shown in FIG. 5D, the handle 3011 is oriented substantially vertically in relation to the screw 315. In other embodiments of the present disclosure, the handle 3011 and the screw 315 may be oriented parallel to each other through different ratchet mechanisms. In some embodiments of the present disclosure, the structure of adjustment mechanisms 302, 303, 304 is similar to or the same as the structure of adjustment mechanism 301.

Figure 6A:
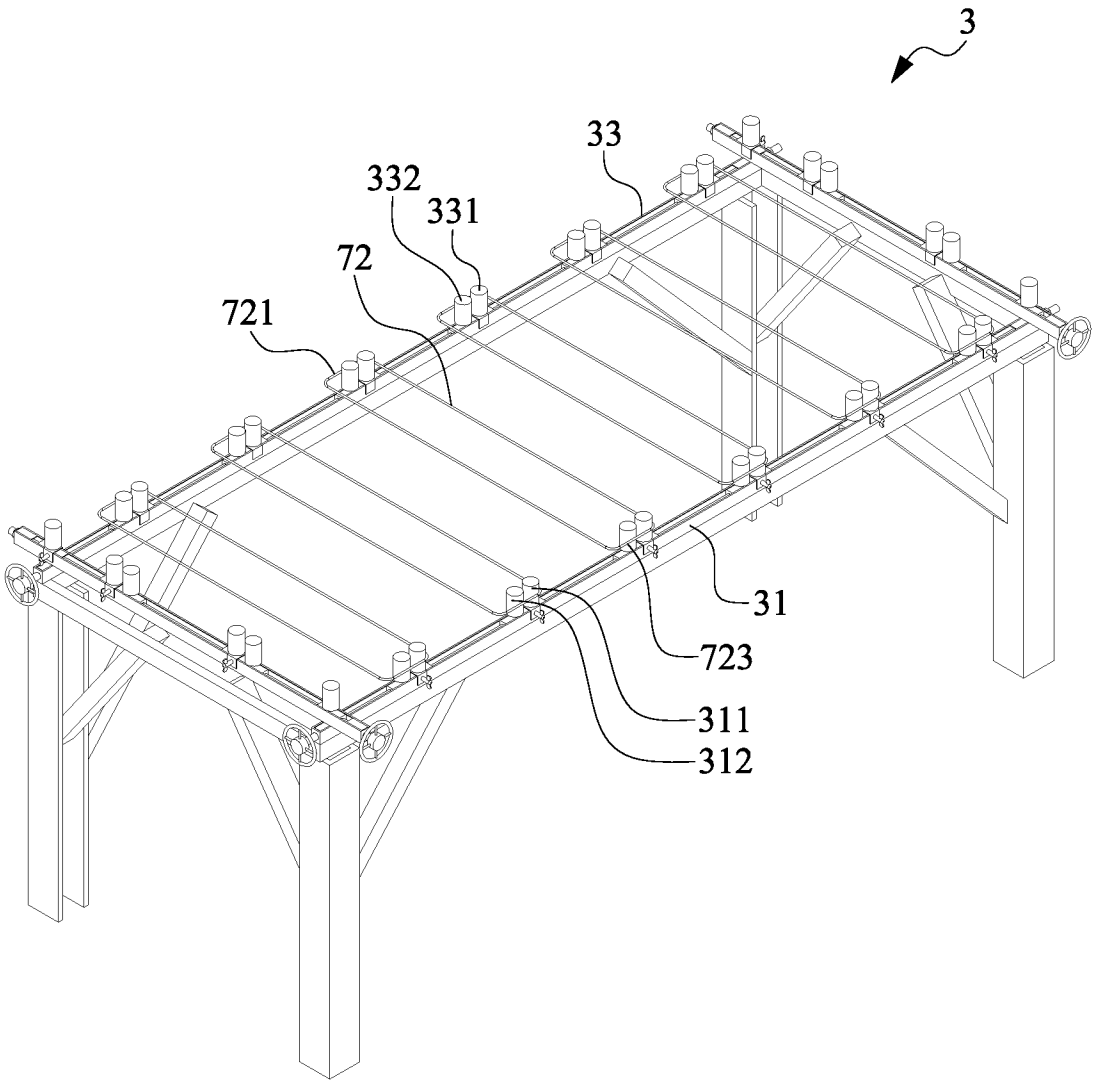
FIG. 6A is a first schematic view showing fabrication of a reinforcement unit in accordance with one embodiment of the present disclosure.

FIG. 6A, FIG. 6B, FIG. 6C, FIG. 6D, and FIG. 6E show a method for manufacturing a reinforcement unit by using the jig 3 as disclosed above. As shown in FIG. 6A, multiple stirrups 72 are provided, with each of these stirrups being formed by bending a single steel bar into a substantially rectangular structure. The multiple stirrups 72 are placed on the jig 3, and in particular, each of them is fitted with both ends on the sides 31 and 33 of the jig. At least a portion of the stirrup 72 abuts the positioning element 311 on the side 31 and the positioning element 331 on the side 33 of the jig 3. For example, the side 721 of the stirrup 72 abuts against the positioning element 331 on the side 33 of the jig 3, and the side 723 of the stirrup 72 abuts against the positioning element 311 on the side 31 of the jig 3. In other words, the user can adjust the positions of the positioning elements 311 and the positioning elements 331 on the jig 3 to position the multiple stirrups 72. That is, the positions of the positioning elements 311 on the side 31 and the positioning elements 331 on the side 33 of the jig 3 predetermine the final positions of the stirrups 12, 13, and 14 in the reinforcement unit. In some embodiments of the present disclosure, in this step, the holding elements 312 on the side 31 of the jig 3 and the holding elements 332 on the side 33 may not be in contact with the stirrups 72.

Figure 6B:
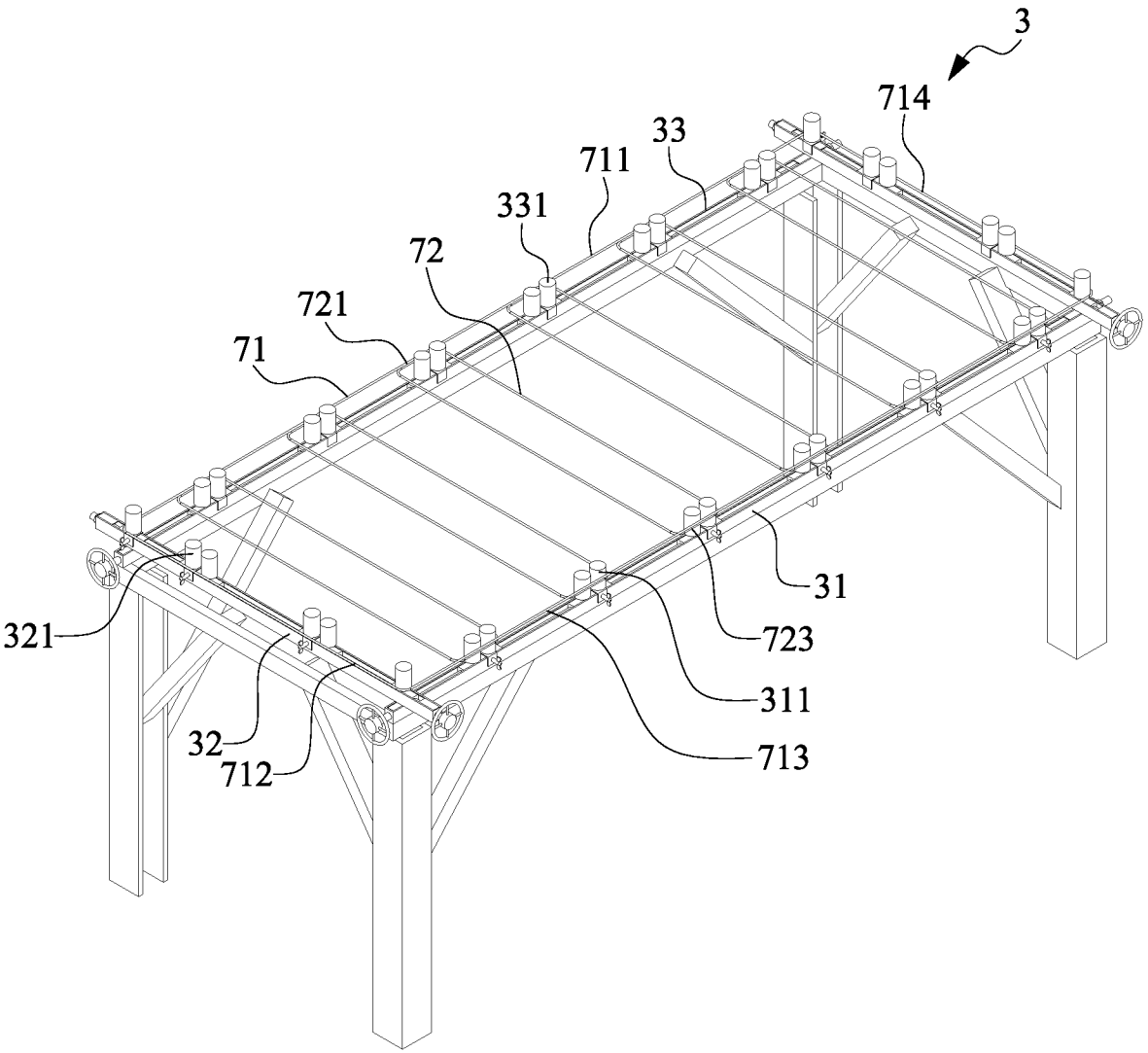
FIG. 6B is a second schematic view showing fabrication of a reinforcement unit in accordance with one embodiment of the present disclosure.

As shown in FIG. 6B, a substantially rectangular stirrup 71 is provided, which has sides 711, 712, 713, and 714, where the side 711 is opposite to the side 713, and the side 712 is opposite to the side 714. The stirrup 71 is placed on the jig 3 in such a way that the sides 711, 712, 713, and 714 of the stirrup are substantially fitted over the outer edges of the sides 31, 32, 33, and 34 of the jig 3. Additionally, the stirrup 71 is also positioned on the multiple stirrups 72 in a manner that allows the sides 711 and 713 of the stirrup 71 to be closely adjacent to or in contact with the stirrups 72. At least a portion of the stirrup 71 is in contact with the positioning elements 311 on the side 31, the positioning elements 321 on the side 32, the positioning elements 331 on the side 33, and the positioning elements 341 on the side 34 of the jig 3. For example, the side 711 of the stirrup 71 is in contact with the positioning element 331 on the side 33 of the jig 3, the side 712 of the stirrup 71 is in contact with the positioning element 321 on the side 32 of the jig 3, the side 713 of the stirrup 71 is in contact with the positioning element 311 on the side 31 of the jig, and the side 714 of the stirrup 71 is in contact with the positioning element 341 on the side 34 of the jig 3. In this way, the stirrup 71 is positioned and secured by the jig 3.

Figure 6C:
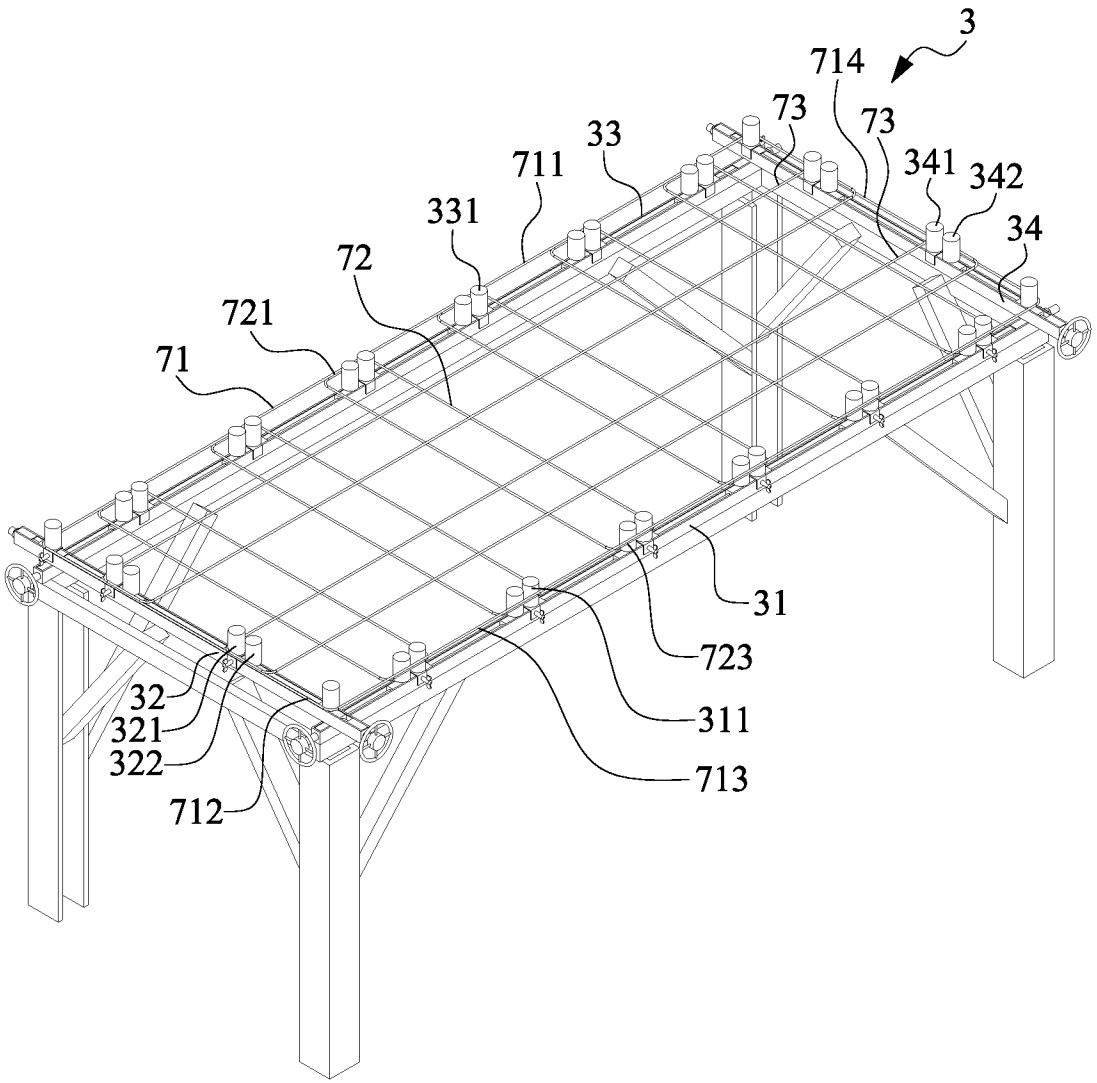
FIG. 6C is a third schematic view showing fabrication of a reinforcement unit in accordance with one embodiment of the present disclosure.

As shown in FIG. 6C, multiple stirrups 73 are provided, each of which is formed by bending a single steel bar to form a substantially rectangular structure. The multiple stirrups 73 are placed on the jig 3, and these stirrups 73 are also positioned on the tops of both stirrups 71 and 72. The stirrups 73 are positioned in close proximity to or in contact with the sides 712 and 714 of the stirrup 71. At least a portion of stirrup 73 is in contact with the positioning element 321 on the side 32 of the jig 3 and the positioning element 341 on the side 34 of the jig 3. In other words, the user can adjust the positioning elements 321 and 341 on the jig 3 to position the stirrups 73. The positions of the positioning elements 321 on the side 32 of the jig 3 and the positioning elements 341 on the side 34 of the jig 3 predetermine the final positions of the stirrups 73 in the reinforcement unit. In some embodiments of the present disclosure, in this step, the holding elements 322 on the side 32 of the jig 3 and the holding elements 342 on the side 34 of the jig 3 may not be in contact with the stirrup 73.

Figure 6D:
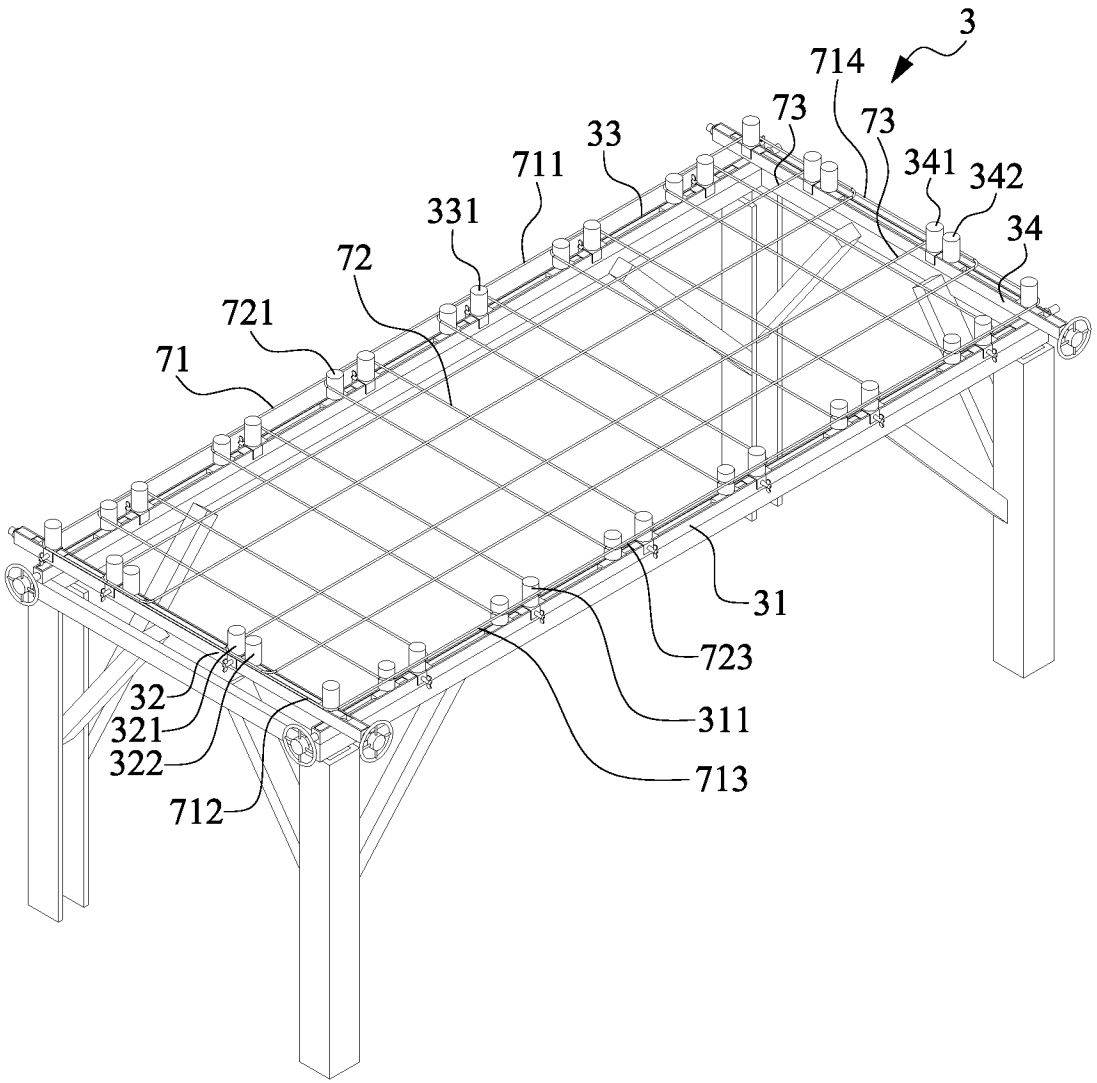
FIG. 6D is a fourth schematic view showing fabrication of a reinforcement unit in accordance with one embodiment of the present disclosure.
Figure 6E:
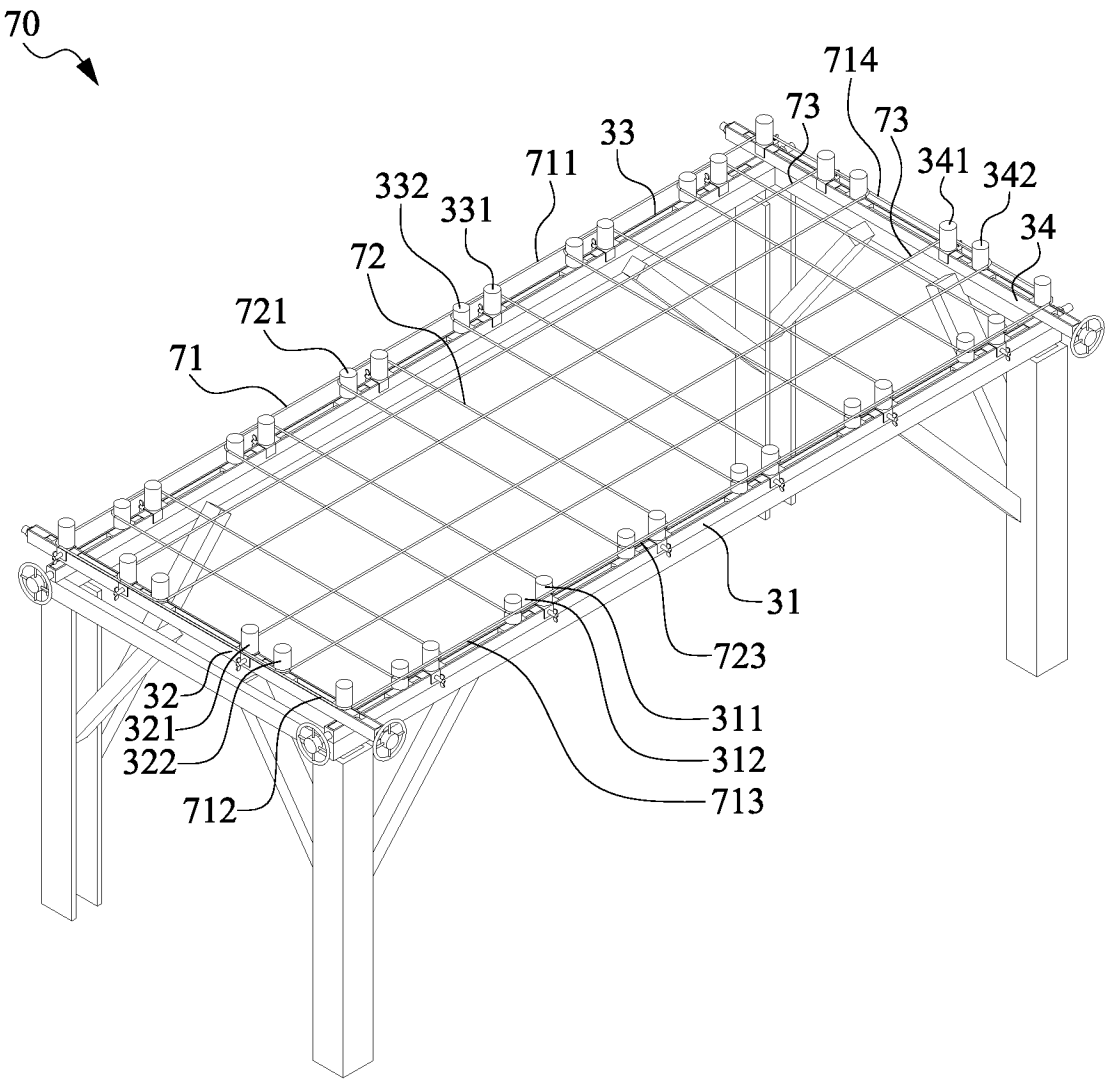
FIG. 6E is a fifth schematic view showing fabrication of a reinforcement unit in accordance with one embodiment of the present disclosure.

As shown in FIG. 6D, the holding elements 322 on the side 32 of the jig 3 and the holding elements 342 on the side 34 of the jig 3 are moved to make contacts with the stirrups 72. This secures stirrups 72 in place and prevents it from being moved. As shown in FIG. 6E, the holding elements 312 on the side 31 of the jig 3 and the holding elements 332 on the side 33 of the jig 3 are moved to make contacts with the stirrup 73. This secures stirrup 73 in place and prevents it from being moved.

After the stirrups 71, 72, and 73 have been positioned and secured by the jig 3, they are ready to be connected to each other to form the reinforcement unit 70. Furthermore, the jig 3 can also be used to manufacture reinforcement units like the one shown in FIG. 2D and/or the steel unit shown in FIG. 3C.

Figure 7A:
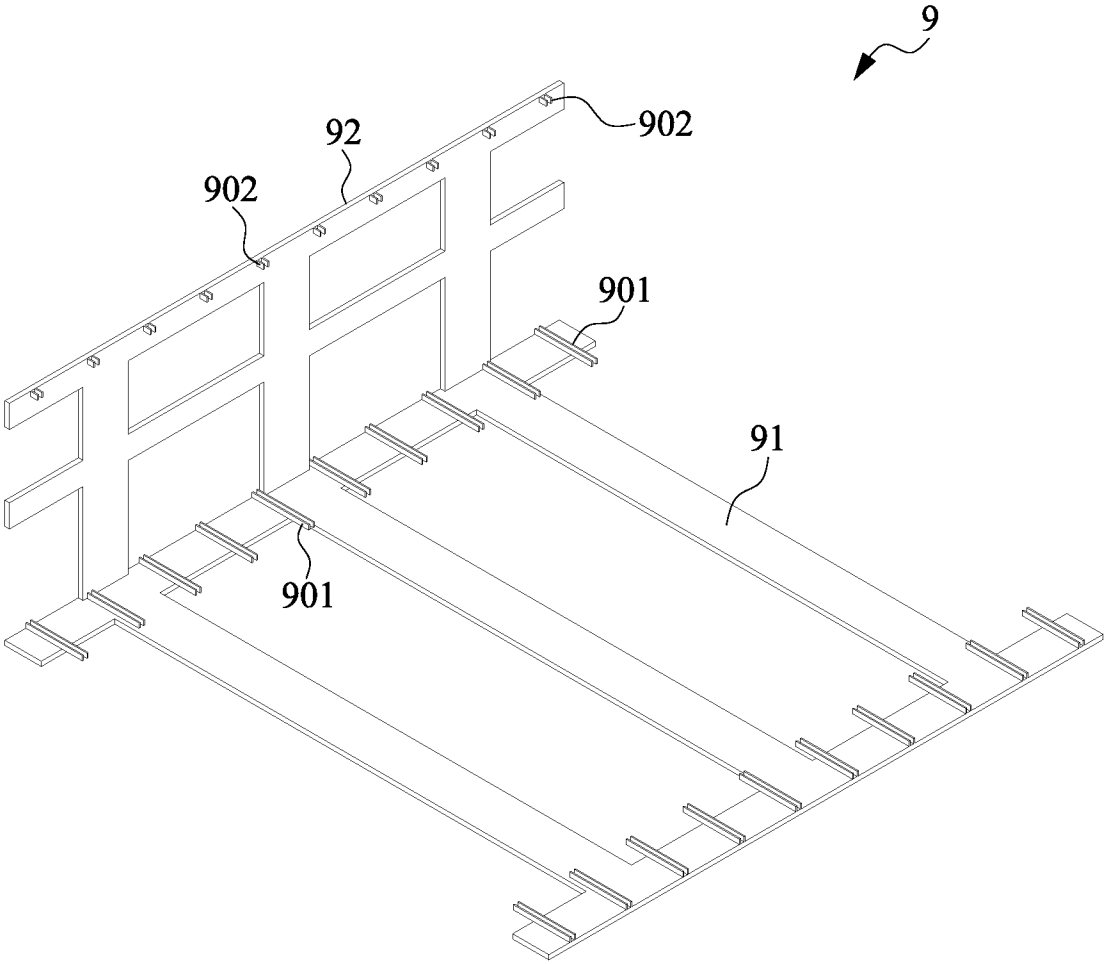
FIG. 7A is a first schematic view showing fabrication of a reinforcement cage in accordance with one embodiment of the present disclosure.
Figure 7B:
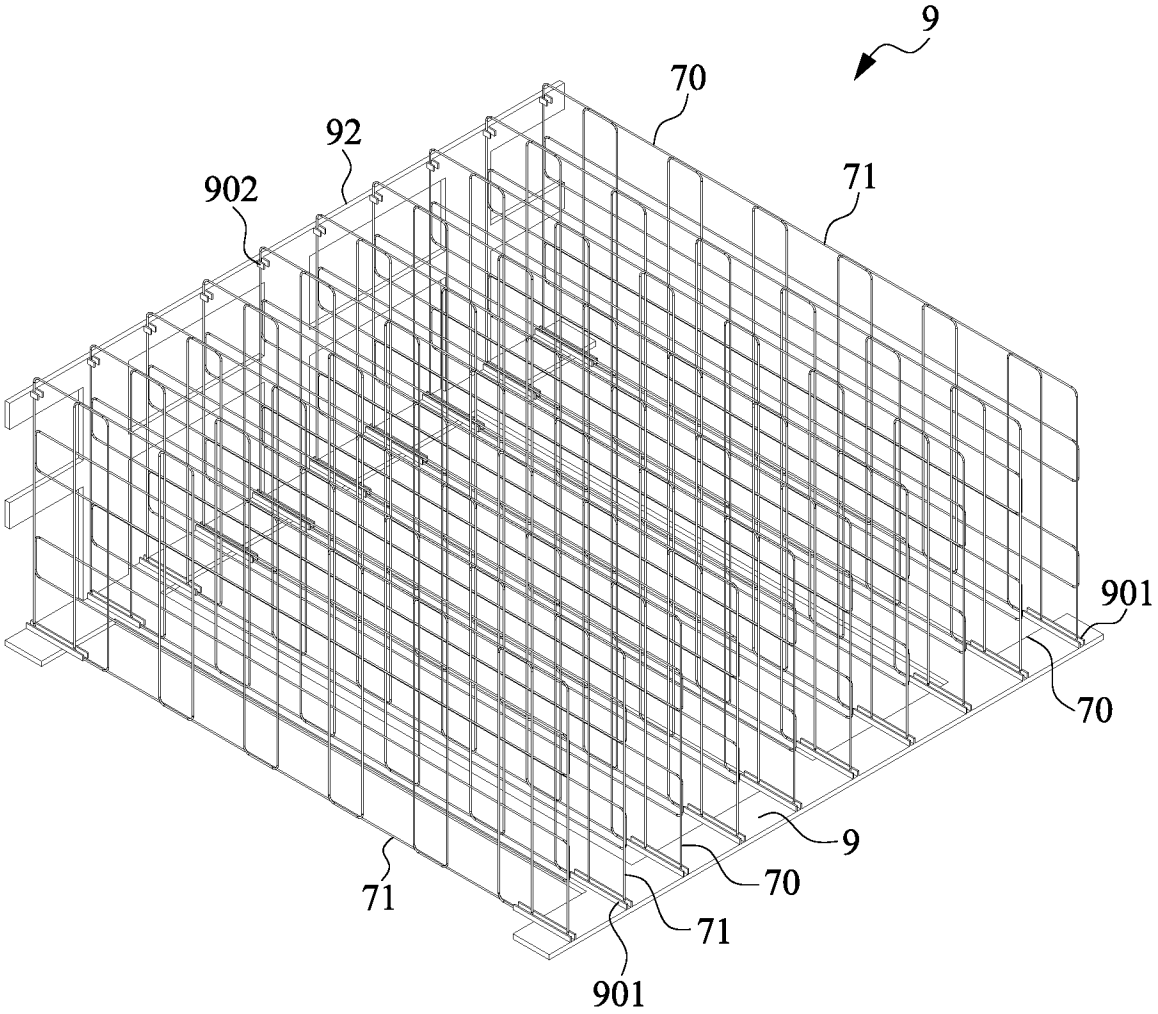
FIG. 7B is a second schematic view showing fabrication of a reinforcement cage in accordance with one embodiment of the present disclosure.
Figure 7C:
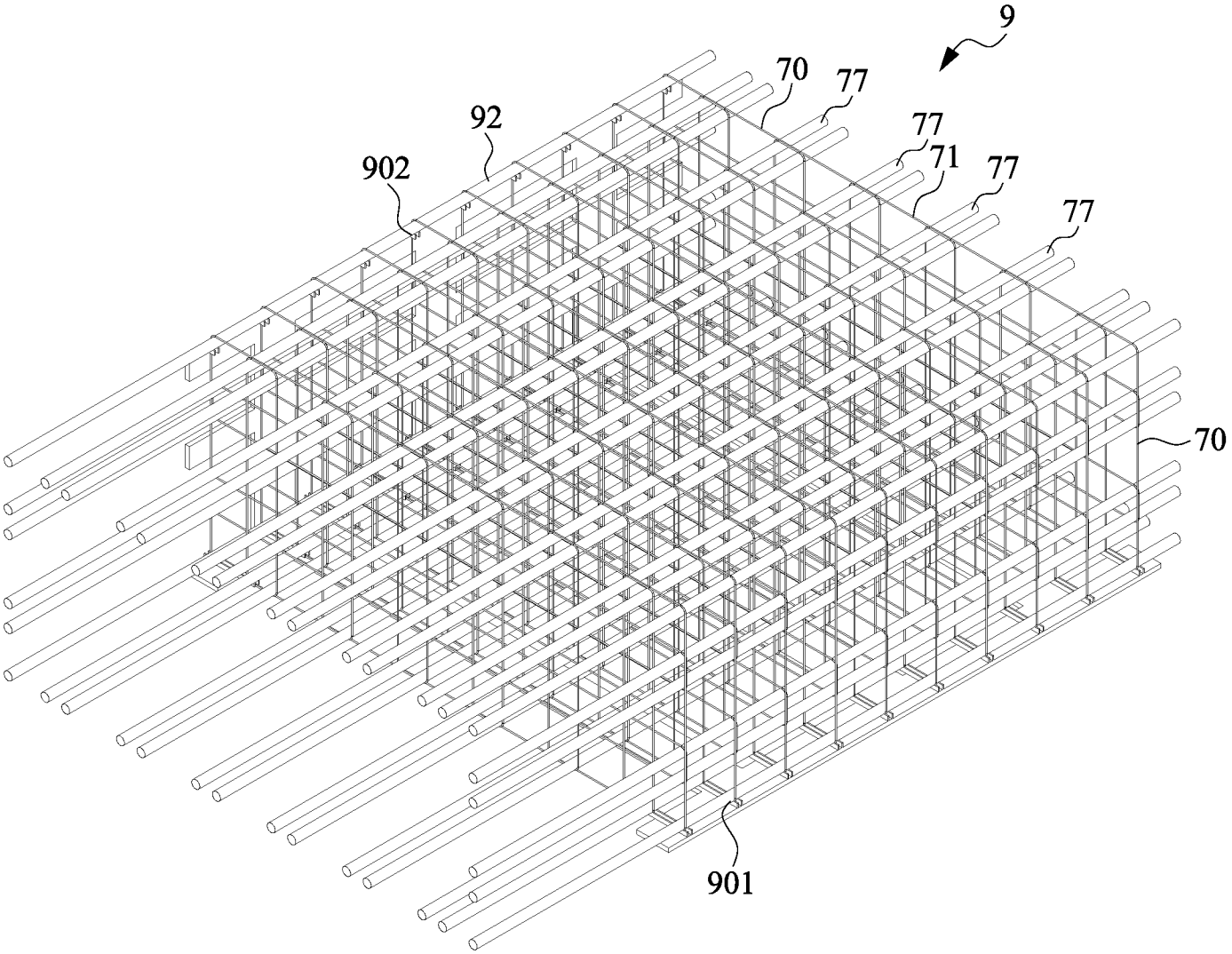
FIG. 7C is a third schematic view showing fabrication of a reinforcement cage in accordance with one embodiment of the present disclosure.

FIG. 7A, FIG. 7B, and FIG. 7C shows a method for manufacturing a reinforcement cage using the jig 9 in accordance with the embodiments of the present disclosure. As shown in FIG. 7A, the jig 9 for manufacturing the reinforcement cage is provided. The jig 9 may include a support 91 and a support 92, and the support 91 and the support 92 are angled with respect to each other. In some embodiments of the present disclosure, the support 91 and the support 92 are angled at 90-degrees to each other. In some embodiments of the present disclosure, the support 91 may be substantially parallel to a ground or a horizontal plane, while the support 92 is substantially perpendicular to the ground or the horizontal plane. The support 91 has multiple positioning devices 901 arranged at predetermined intervals, while the support 92 has multiple positioning devices 902 arranged at predetermined intervals. In some embodiments of the present disclosure, the multiple positioning devices 901 correspond to or are aligned with the multiple positioning devices 902, respectively.

As shown in FIG. 7B, the multiple reinforcement units 70 are hoisted and positioned on the jig 9, with their adjacent sides abutting against support 91 and support 92 of the jig 9. They can be securely held in place by the positioning devices 901 of the support 91 and positioning devices 902 of the support 92. With reference to FIG. 7B, the multiple reinforcement units 70 located on the jig 9 are arranged in parallel to each other and secured at predetermined intervals. In some embodiments of the present disclosure, the reinforcement units such as those shown in FIG. 2D (reinforcement unit 10) and FIG. 3C (reinforcement unit 20) are able to be placed on fixture 9.

As shown in FIG. 7C, multiple main bars 77 are passed through the multiple reinforcement units 70 positioned on the jig 9 in a direction that is substantially perpendicular to the reinforcement units 70. The main bars 77 that are passed through the multiple reinforcement units 70 are in close proximity to the sides of each reinforcement unit 70. That is, the main bars 77 are positioned on or closely adjacent to the four sides of the stirrups 71 of the reinforcement units 70. As a result, the main bars 77 are secured to the four sides of the stirrups 71 of the reinforcement unit 70 and a reinforcement cage is formed.

In some embodiments, the jig 9 can also be used to manufacture reinforcement cage 100 as shown in FIG. 1A and FIG. 1B, and/or steel cage 200 as shown in FIG. 1B and FIG. 1C.

The above embodiments merely describe the principle and effects of the present disclosure, instead of being used to limit the present disclosure. Therefore, persons skilled in the art can make modifications to and variations of the above embodiments without departing from the spirit of the present disclosure. The scope of the present disclosure should be defined by the appended claims.

What is claimed is:

1. A reinforcement cage, comprising:

a plurality of reinforcement units, disposed along a first direction, each of the reinforcement units comprising:

a first stirrup, which is substantially rectangular and comprises a first side, a second side, a third side and a fourth side, wherein the first side is opposite to the third side, and the second side is opposite to the fourth side;

at least one second stirrup, configured to be connected to the first side and the third side of the first stirrup; and at least one third stirrup, configured to be connected to the second side and the fourth side of the first stirrup and being substantially perpendicular to and fixed to the at least one second stirrup; and a plurality of main bars, extending along the first direction, through the plurality of reinforcement units, and being fixed to the first side, the second side, the third side and the fourth side of the first stirrup of each of the plurality of reinforcement units;

wherein the second stirrup of the reinforcement unit is a substantially rectangular structure formed by bending a single steel bar and comprises a substantially elongated rectangular structure therein, wherein two ends of the bent single steel bar respectively form a first hook and a second hook, and wherein the first hook is located at a corner of the rectangular structure and bent toward an inner side of the second stirrup, and the second hook is located within the elongated rectangular structure, wherein a bending direction of the first hook is different from a bending direction of the second hook; and wherein the at least one second stirrup comprises three second stirrups, which are disposed in parallel within the first stirrup, and wherein a width of the second stirrup located at a middle of the first stirrup is smaller than a width of the second stirrups located at two opposing sides of the first stirrup, and the second stirrups located at two opposing sides of the first stirrup are arranged in a mirror imaged manner with respect to the second stirrup located at the middle of the first stirrup.

2. The reinforcement cage of claim 1, wherein the first hook and the second hook of the second stirrup are configured to hook the main bars enclosed by the first stirrup and fixed to the first side or the third side of the first stirrup.

3. The reinforcement cage of claim 1, wherein a length of the first side or the third side of the first stirrup is greater than a length of the second side or the fourth side of the first stirrup, and wherein the third stirrup surrounds at least two of the main bars, which are enclosed by the first stirrup and fixed to the second side of the first stirrup, and surrounds at least two of the main bars, which are enclosed by the first stirrup and fixed to the fourth side of the first stirrup.

4. The reinforcement cage of claim 1, wherein the third stirrup of the reinforcement unit is a substantially elongated rectangular structure formed by bending a single steel bar, wherein two ends of the bent single steel bar respectively form a third hook and a fourth hook, and wherein the third hook and the fourth hook are located at a corner of the third stirrup and are next to each other, and wherein the third hook and the fourth hook are configured to substantially hook the main bars enclosed by the first stirrup and fixed to the second side or the fourth side of the first stirrup.

5. The reinforcement cage of claim 1, wherein the first stirrup forms an outer contour of each of the reinforcement units and defines a size and a shape of the reinforcement unit.

6. The reinforcement cage of claim 1, wherein the plurality of reinforcement units are arranged parallel to each other substantially along the first direction.

7. The reinforcement cage of claim 1, wherein the at least one second stirrup is substantially perpendicular to the first side and the third side of the first stirrup.

8. The reinforcement cage of claim 4, wherein the third hook and the fourth hook of the third stirrup hook onto at least two of the plurality of main bars.

9. The reinforcement cage of claim 1, wherein the first stirrup is formed by bending a single steel bar such that the first side, the second side, the third side, and the fourth side are integrally formed.

10. The reinforcement cage of claim 1, wherein the reinforcement cage is configured for an end structural member of a shear wall.

11. The reinforcement cage of claim 1, wherein the second stirrups located at the two opposing sides of the first stirrup are symmetrically arranged with respect to each other.

12. The reinforcement cage of claim 3, wherein a length of the first side of the first stirrup is approximately 2400 mm, and a length of the second side of the first stirrup is approximately 1200 mm.

13. A reinforcement cage, comprising:

a plurality of reinforcement units, disposed along a first direction, each of the reinforcement units comprising:

a first stirrup, which is substantially rectangular and comprises a first side, a second side, a third side and a fourth side, wherein the first side is opposite to the third side, and the second side is opposite to the fourth side;

at least one second stirrup, configured to be connected to the first side and the third side of the first stirrup; and at least one third stirrup, configured to be connected to the second side and the fourth side of the first stirrup and being substantially perpendicular to and fixed to the at least one second stirrup; and a plurality of main bars, extending along the first direction, through the plurality of reinforcement units, and being fixed to the first side, the second side, the third side and the fourth side of the first stirrup of each of the plurality of reinforcement units;

wherein the second stirrup of the reinforcement unit is a substantially rectangular structure formed by bending a single steel bar and comprises a substantially elongated rectangular structure therein, wherein two ends of the bent single steel bar respectively form a first hook and a second hook, and wherein the first hook is located at a corner of the rectangular structure and bent toward an inner side of the second stirrup, and the second hook is located within the elongated rectangular structure, wherein a bending direction of the first hook is different from a bending direction of the second hook; and wherein the first hook and the second hook of the second stirrup hook onto at least two of the plurality of main bars.

14. A reinforcement cage, comprising:

a plurality of reinforcement units, disposed along a first direction, each of the reinforcement units comprising:

a first stirrup, which is substantially rectangular and comprises a first side, a second side, a third side and a fourth side, wherein the first side is opposite to the third side, and the second side is opposite to the fourth side;

at least one second stirrup, configured to be connected to the first side and the third side of the first stirrup; and at least one third stirrup, configured to be connected to the second side and the fourth side of the first stirrup and being substantially perpendicular to and fixed to the at least one second stirrup; and a plurality of main bars, extending along the first direction, through the plurality of reinforcement units, and being fixed to the first side, the second side, the third side and the fourth side of the first stirrup of each of the plurality of reinforcement units;

wherein each of the reinforcement units further comprises a fourth stirrup and a fifth stirrup, wherein the fourth stirrup and the fifth stirrup connect the second side and the fourth side of the first stirrup.

* * * * *